US008033543B2

(12) United States Patent
Hayashi

(10) Patent No.: US 8,033,543 B2
(45) Date of Patent: Oct. 11, 2011

(54) SHEET STACKING APPARATUS AND IMAGE FORMING APPARATUS

(75) Inventor: Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 759 days.

(21) Appl. No.: 11/874,303

(22) Filed: Oct. 18, 2007

(65) Prior Publication Data

US 2008/0099972 A1 May 1, 2008

(30) Foreign Application Priority Data

Oct. 31, 2006 (JP) ..... 2006-297135

(51) Int. Cl.
*B65H 31/04* (2006.01)
*B65G 57/00* (2006.01)
*G03G 15/00* (2006.01)

(52) U.S. Cl. ..... 271/213; 271/217; 271/220; 271/221; 414/791.2; 399/404

(58) Field of Classification Search ..... 271/213, 271/215, 217, 220, 221; 414/791.2; 399/404
See application file for complete search history.

(56) References Cited

U.S. PATENT DOCUMENTS

| | | | | |
|---|---|---|---|---|
| 6,871,851 | B2 | 3/2005 | Tamura et al. | 271/221 |
| 7,192,020 | B2 | 3/2007 | Hayashi et al. | 270/58.11 |
| 7,288,059 | B2 | 10/2007 | Ikeda et al. | 493/444 |
| 2002/0079642 | A1 | 6/2002 | Masahiro et al. | |
| 2005/0179190 | A1 | 8/2005 | Kamiya et al. | 270/58.07 |
| 2005/0189706 | A1 | 9/2005 | Tamura et al. | |
| 2006/0017209 | A1 | 1/2006 | Kushida et al. | 270/37 |
| 2006/0017218 | A1 | 1/2006 | Kawata et al. | 271/207 |
| 2006/0018694 | A1 | 1/2006 | Hayashi | 399/406 |
| 2007/0060459 | A1 | 3/2007 | Hayashi | 493/434 |
| 2007/0075479 | A1 | 4/2007 | Obuchi et al. | 271/109 |
| 2007/0102860 | A1 | 5/2007 | Hayashi et al. | 270/58.11 |
| 2007/0108690 | A1 | 5/2007 | Hayashi et al. | 270/58.27 |
| 2007/0161489 | A1 | 7/2007 | Ikeda et al. | 493/444 |

FOREIGN PATENT DOCUMENTS

| | | | |
|---|---|---|---|
| EP | 0 636 499 A | | 2/1995 |
| JP | 55119656 A | * | 9/1980 |
| JP | 2002-179326 | | 6/2002 |
| JP | 2003-002524 | | 1/2003 |

OTHER PUBLICATIONS

Official Letter/Search Report, issued by the European Patent Office, on Jan. 28, 2008, in European Patent Application No. 07119796.6.
Official Letter/Search Report, dated Jul. 24, 2009, issued by The Patent Office of the People's Republic of China, in Chinese Application No. 200710168204.6.

* cited by examiner

*Primary Examiner* — David H Bollinger
(74) *Attorney, Agent, or Firm* — Fitzpatrick, Cella, Harper & Scinto

(57) ABSTRACT

An image forming apparatus has a sheet stacking apparatus including a tray on which sheets are stacked, and an aligning member aligning the sheets stacked on the tray. The aligning member aligns sheets stacked, on a sheet previously stacked on the tray, with a displacement in an aligning direction of the aligning member with respect to the sheet previously stacked. An aligning operation of the aligning member is changed on the basis of whether or not the number of the sheets stacked on the sheets previously stacked is a predetermined number or less.

16 Claims, 17 Drawing Sheets

SHEET STACKING APPARATUS AND IMAGE FORMING APPARATUS

BACKGROUND OF THE INVENTION

1. Field of the Invention

The present invention relates to a sheet stacking apparatus and an image forming apparatus.

2. Description of Related Art

Recently, a sheet stacking apparatus with a larger capacity for stacking discharged sheets has been required not only with a larger capacity, but also with the capability to stack sheets with high accuracy.

In a sheet stacking apparatus, it is conceivable that another sheet bundle is stacked on a previously stacked sheet bundle in a different position. The reason that another sheet bundle is stacked on the previously stacked sheet bundle is, for example, to notify the user of the position of the boundary between the sheet bundles (i.e. different print jobs).

Here, it is known that another sheet bundle stacked on the previous one can have the sheet edges aligned by an aligning member so that alignment of the bundles is improved. Japanese Patent Application Laid-Open No. 2002-179326 describes such a configuration, in which a sheet stacked on a previously stacked sheet bundle is aligned at a position different to that of the sheet bundle previously stacked by a pair of aligning members.

FIGS. 18A and 18B illustrate a configuration disclosed in Japanese Patent Application Laid-Open No. 2002-179326. FIGS. 18A and 18B illustrates an operation of aligning members 801*a* and 801*b* when a second sheet bundle F2 is stacked with a displacement with respect to the position of a first sheet bundle F1. After a sheet of the second sheet bundle drops on the first sheet bundle F1 in the condition that the center of the sheet is aligned with the sheet feeding center, the aligning member 801*a* moves in a direction indicated by the arrow Ja in FIG. 18B to jog the sheet edge for aligning. Note that the aligning member 801*b* stands still even when the aligning member 801*a* is moving. The aligning operation by the aligning member 801*a* is carried out every time a sheet drops on the sheet bundle.

In Japanese Patent Application Laid-Open No. 2003-002524, a sheet is discharged on a stapled sheet bundle, and aligning members move to align the discharged sheet. The aligning members move to align the sheet while it is being laid on the stapled sheet bundle. The aligning operation is carried out every time a predetermined number of sheets are discharged on the stapled sheet bundle so, that unnecessary aligning operations can be eliminated.

In the configuration disclosed in Japanese Patent Application Laid-Open 2002-179326, aligning members (jogging members) are laid on the previously stacked sheet bundle when aligning the edges of discharged sheets. Therefore when an aligning operation is carried out while moving the aligning members, the uppermost sheet of the previously stacked sheet bundle is fed together with the aligning member in association with the movement of the aligning members, and thus the alignment of the previously stacked sheets is disturbed. When the aligning operation is repeated, the amount of deviation of the sheets is further increased.

SUMMARY OF THE INVENTION

The present invention has been developed in view of such circumstances and provides a sheet stacking apparatus and an image forming apparatus that can achieve a steady stack of sheets without disordering the alignment of a previously stacked sheet bundle, even when sheet bundles are displaced from one another (staggered) and stacked.

According to an aspect of the present invention, a sheet stacking apparatus comprises:

a tray on which sheets are stacked;

an aligning member which aligns the sheets stacked on the tray, wherein the aligning member aligns sheets, stacked on a sheet previously stacked on the tray, with a displacement in an aligning direction of the aligning member with respect to the sheet previously stacked; and a changing unit which changes the aligning operation of the aligning member based on whether or not the number of sheets stacked on the sheet previously stacked is less than or equal to a predetermined number.

According to the present invention, the sheet stacking apparatus can reduce the disorder of the alignment of sheets previously stacked on the tray and hence achieve a good alignment of the previously stacked sheets.

Further features of the present invention sill become apparent from the following description of exemplary embodiments with reference to the attached drawings.

DESCRIPTION OF THE EMBODIMENTS

Figure 1:
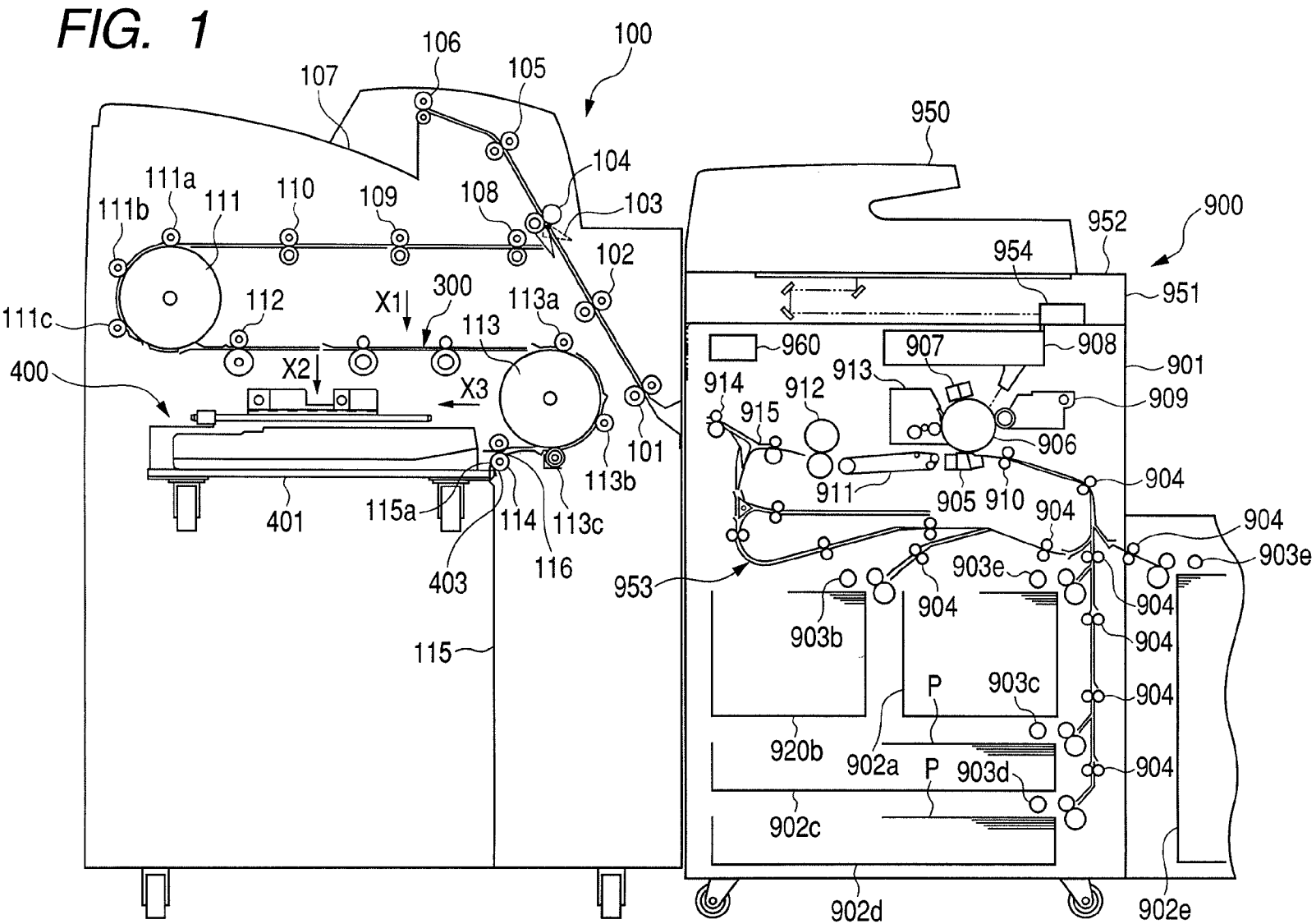
FIG. 1 is a diagram illustrating a configuration of an image forming apparatus including a sheet stacking apparatus according to an embodiment of the present invention.

An exemplary embodiment for carrying out the present invention will now be described in detail referring to the drawings.

FIG. 1 is a diagram illustrating a configuration of an image forming apparatus including a sheet stacking apparatus according to an embodiment of the present invention.

In FIG. 1, an image forming apparatus main body 901 of an image forming apparatus 900 includes an image reading apparatus 951 provided with a scanner unit 955 and an image sensor 954, an image forming portion 902 to form an image on a sheet, a two-side reversing device 953, and a platen glass 952. In addition, a document feeder 950 for feeding documents to the platen glass 952 is provided on the top face of the image forming apparatus main body 901.

The image forming portion 902 includes a cylindrical photosensitive drum 906, a charging device 907, a developing device 909, a cleaning device 913, and in addition, a fixing device 912 and a pair of discharging rollers 914 are disposed downstream of the image forming portion 902. Also, the image forming apparatus main body 901 is connected to a stacker 100, which is a sheet stacking apparatus for stacking sheets, on which images are formed, discharged from the image forming apparatus main body 901. A controller 960 controls the image forming apparatus main body 901 and the stacker 100.

Next, an image forming operation of the image forming apparatus main body 901 configured as above will be described.

When an image forming signal is output from the controller 960, firstly a document is placed on the platen glass 952 by the document feeder 950 and the document image is read by the image reading device 951. Digital data obtained through reading is input to an exposure unit 908, by which light according to the digital data is irradiated onto the photosensitive drum 906.

On this occasion the surface of the photosensitive drum 906 is uniformly charged by the charging device 907. When light is irradiated as described above, an electrostatic latent image is formed on the surface of the photosensitive drum. Through development of the electrostatic latent image by the developing device 909, a toner image is formed on the surface of the photosensitive drum.

In the meanwhile, when a sheet feeding signal is output from the controller 960, firstly sheets P, which are set in cassettes 902*a*, 902*b*, 902*c*, 902*d* and 902*e*, are conveyed to the registration roller 910 through the feeding rollers 903*a*, 903*b*, 903*c*, 903*d* and 903*e*, and a pair of conveying rollers 904.

Then sheets P are conveyed by the registration roller 910 to a transfer portion which includes a transfer-separation charging device 905 in such a timing that the leading edge of a sheet is aligned with the leading edge of the toner image on the photosensitive drum 906. Then, in the transfer portion, a transfer bias is applied to the sheet P by the transfer-separation charging device 905, and thus the toner image on the photosensitive drum 906 is transferred to the sheet.

Subsequently, the sheet P on which a toner image was transferred is conveyed to the fixing device 912 by a conveying belt 911, and thereafter the toner image is thermal-fixed while conveying in the condition being nipped between a heating roller and a pressure roller of the fixing device 912. Meanwhile foreign substances such as residual toner not transferred to the sheet but stuck onto the photosensitive drum 906 are scraped off the drum by a blade of the cleaning device 913. Consequently the surface of the photosensitive drum 906 is cleaned to be ready for the next image formation operation.

The fixed sheet is conveyed to the stacker 100 as it stands by the discharging roller 914 or conveyed to the two-side reversing device 953 by a flapper 915 to perform an image forming process again.

In the meanwhile, the stacker 100 is provided with a top tray 107 on the top face thereof for stacking the sheets discharged from the image forming apparatus main body 901. The stacker 100 also performs skew feed correction and lateral registration correction (positional correction in the direction intersecting the conveying direction) of the sheets fed from the image forming apparatus main body 901. In addition, the stacker 100 includes a grouping portion 300 where sorting in the shift mode, which is described later, is carried out.

Moreover the stacker 100 includes a stacking portion 400 provided with a stack tray 401 on which sheets are stacked, and a top tray switching flapper 103, which directs sheets conveyed into the stacker 100 toward the top tray 107 or toward the stacking portion 400. The configurations of the grouping portion 300 and the stacking portion 400 will be described later.

Figure 2:
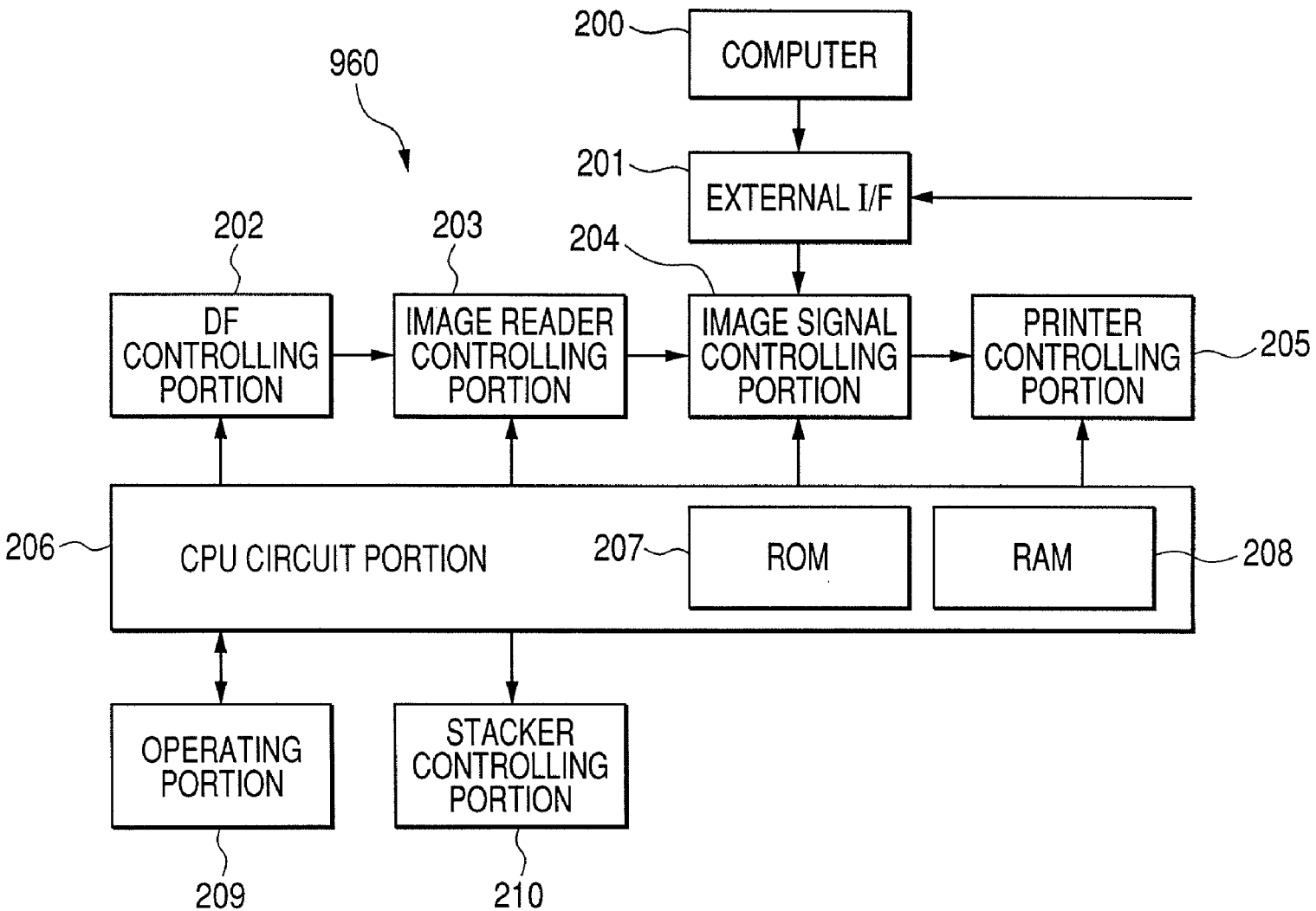
FIG. 2 is a control block diagram of a controller provided in the above image forming apparatus.

FIG. 2 is a block diagram illustrating a configuration of the controller 960. The controller 960 has a CPU circuit portion 206, which includes a CPU (not shown), a ROM 207 and a RAM 208. The controller 960 controls comprehensively, through the control program stored in the ROM 207, a DF (document feeding) controlling portion 202, an operating portion 209, an image reader controlling portion 203, an image signal controlling portion 204, a printer controlling portion 205, and a stacker controlling portion 210. The RAM 208 holds the control data temporarily and is utilized as a working area for computing operation required for control.

The DF (document feeding) controlling portion 202 performs drive control of the document feeding device 950 based on an instruction from the CPU circuit portion 206. The image reader controlling portion 203 performs drive control of the scanner unit 955 and image sensor 954 disposed in the image reading device 951 and transmits analogue image signals output from the image sensor 954 to the image signals controlling portion 204.

The image signal controlling portion 204 converts the analogue image signals from the image sensor 954 to digital signals and thereafter performs various processes. The digital signals are converted to video signals and output to the printer controlling portion 205.

The image signal controlling portion 204 also performs various processes for the digital image signals input from the computer 200 or from outside via an external I/F 201 and converts the digital image signals to video signals to output the video signals to the printer controlling portion 205. Note that the processes through the image signals controlling portion 204 are controlled by the CPU circuit portion 206.

The printer controlling portion 205 drives the exposure unit 908 via an exposure controller (not shown) based on the input video signals. The operating portion 209 includes a plurality of keys for setting various functions regarding image formation and a displaying portion for displaying the information indicating the setting state. The operating portion 209 also outputs key signals corresponding to each key operation to the CPU circuit portion 206 and displays the corresponding information on the display portion based on the signals from the CPU circuit portion 206.

The stacker controlling portion 210 is mounted in the stacker 100 and performs a driving control of the whole stacker through information communication with the CPU circuit portion 206.

Figure 3:
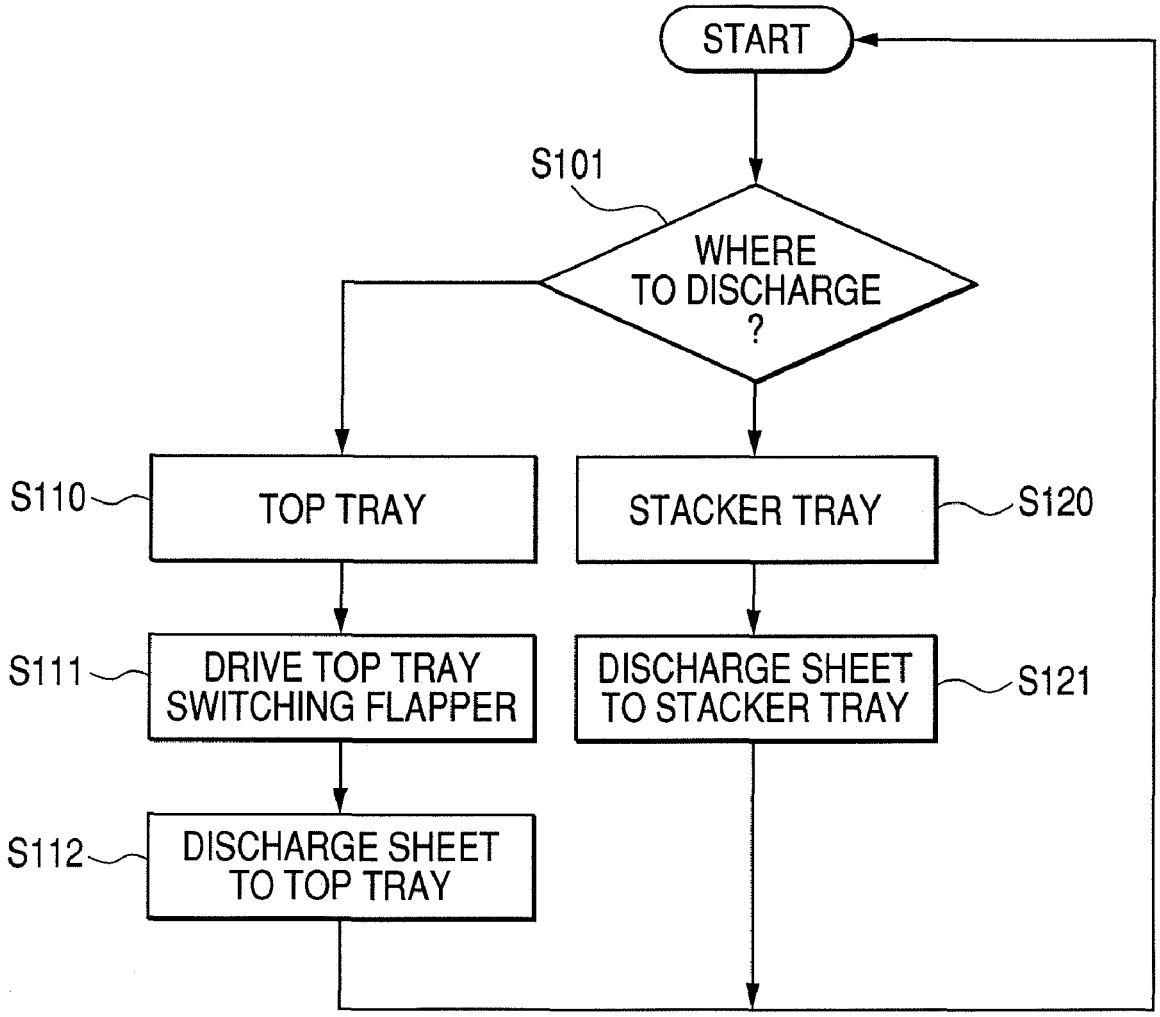
FIG. 3 is a flowchart illustrating a basic control of a stacker connected to an image forming apparatus main body in the above image forming apparatus.

Next, a basic control in the stacker controlling portion 210 of the stacker 100 will be described referring to FIG. 1 and a flowchart of FIG. 3.

The sheet P discharged from the image forming apparatus main body 901 is conveyed into the internal portion by a pair of entrance rollers 101 of the stacker 100 and conveyed to the top tray switching flapper 103 by a pair of conveying rollers 102.

Before the sheet is conveyed, sheet information, such as sheet size, sheet type, where to discharge the sheet and the like have been transmitted to the stacker controlling portion 210 from (the CPU circuit portion 206 of) the controller 960 in the image forming apparatus main body 901.

Here, the stacker controlling portion 210 determines where to discharge the sheet which has been conveyed from the controller 960 (S101). If where to discharge the sheet is to the top tray 107 (S110), the top tray switching flapper 103 is driven (S111) via a solenoid (not shown) to move to the position as illustrated in FIG. 1. Consequently, the sheet P is guided to the pair of conveying rollers 104 and 105, after which the sheet is discharged to the top tray 107 by the top tray discharging roller 106 (S112), then stacked.

If the sheet is to be discharged to the stack tray 401 of the stacking portion 400 (S120), the top tray switching flapper 103 is moved to the dotted line position by a solenoid (not shown). Consequently, the sheet conveyed by the pair of conveying rollers 102 passes between the pairs of conveying rollers 108, 109, 110, and through a nip portion between a large roller 111 and the rollers 111*a*, 111*b*, 111*c*. Further the sheet passes through the conveying roller 112, the grouping portion 300 and the nip portion between the large roller 113 and the rollers 113*a*, 113*b*, 113*c*, thereafter the sheet is discharged to the stacking tray 401 (S121) by the discharging rollers 114, and then stacked.

The grouping portion 300, which corrects skew feed and lateral registration of the sheets conveyed from the image forming apparatus main body 901 as well as providing a space for a sorting operation in the shift mode, which is described later, is arranged between the conveying rollers 112 and the large roller 113 as illustrated in FIG. 1.

Figure 4:
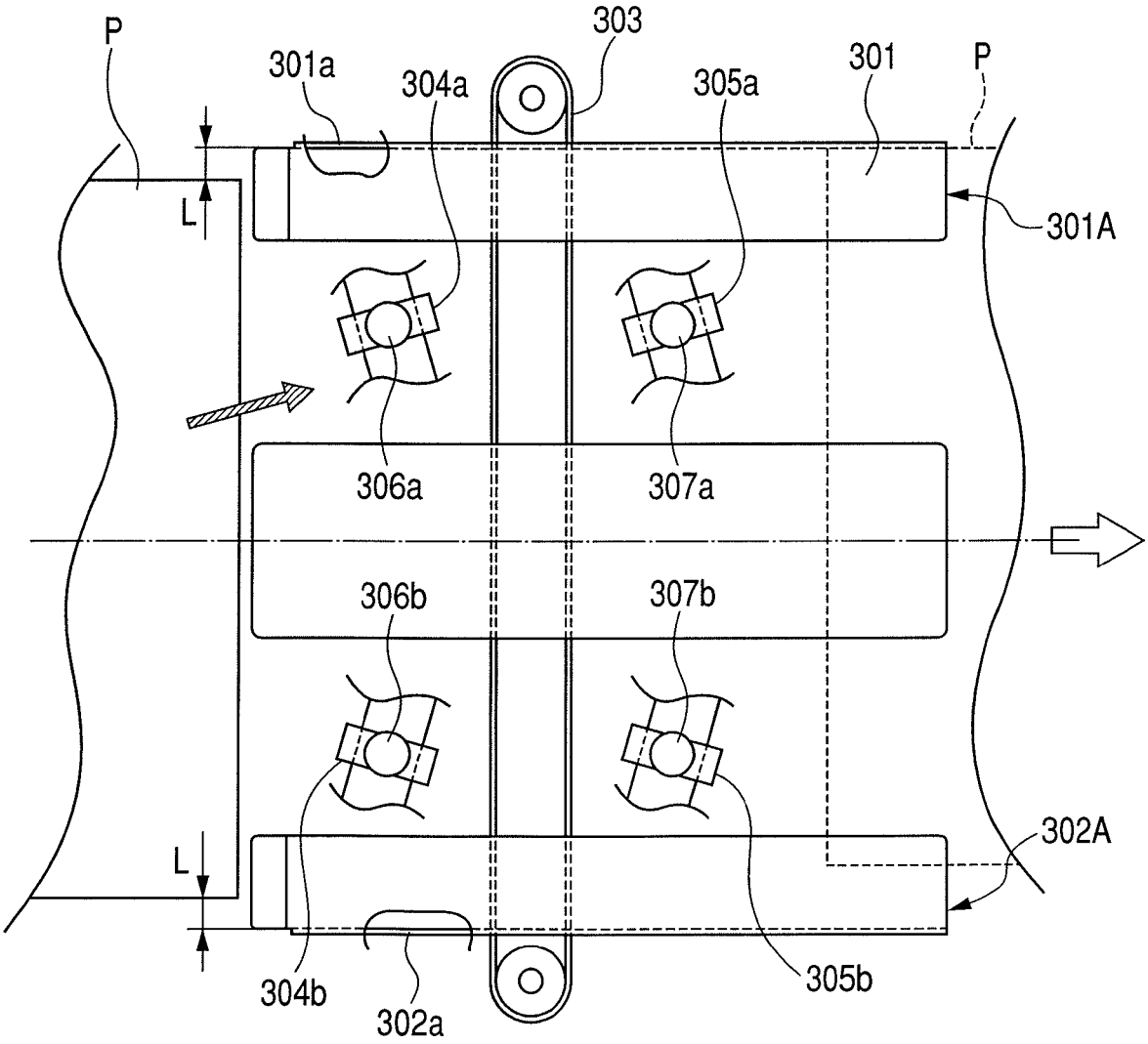
FIG. 4 is a diagram illustrating a configuration of a grouping portion provided in the above stacker.

Here, as indicated by the white arrow in FIG. 4 that is a view looking in the direction indicated by the arrow X1 of FIG. 1, the grouping portion 300 is fixed to a timing belt 303 and is provided with first and second guides 301, 302, which are movable symmetrically with respect to the center line of the sheet conveying direction.

On the opposing side surfaces of the first and second guides 301 and 302, guide portions 301A and 302A are formed, which include a bottom surface supporting the lower surface of the sheet P and a ceiling surface restricting the upward movement of the sheet P, and the abutting surfaces 301*a* and 302*a* against which the side edges of the sheet P abut.

Then, when the sheet P is conveyed, the first and second guides 301 and 302 are in standby positions having the abutting surfaces 301*a* and 302*a* opened wider apart than the dimension of the sheet by a distance L from each side edge of the sheet depending on the sheet size in a condition that the center line of the abutting surfaces 301*a*, 302*a* are aligned with the center line of the sheet conveying direction.

The grouping portion 300 includes first and second oblique-feed rollers 304*a* and 305*a* that are inclined so that the sheet P is fed obliquely toward the first guide side, and includes the third and fourth oblique-feed rollers 304*b* and 305*b* that are inclined so that the sheet P is fed obliquely toward the second guide side. Rollers 306*a* and 307*a* are the first and second rollers that are selectively brought into contact with the first and second oblique-feed rollers 304*a* and 305*a* so as to nip the sheet P. Rollers 306*b* and 307*b* are the third and fourth rollers that are selectively brought into contact with the third and fourth oblique-feed rollers 304*b* and 305*b* so as to nip the sheet P.

Incidentally, the first to the fourth oblique-feed rollers 304*a*, 305*a*, 304*b* and 305*b* are made of rubber or sponge of low coefficient of friction having such property that slipping on the sheet P causes no damage under a predetermined load. The first to the fourth rollers 306*a*, 307*a*, 306*b* and 307*b* are arranged to be brought into contact with the first to the fourth oblique-feed rollers 304*a*, 305*a*, 304*b* and 305*b* selectively by solenoids (not shown).

In the grouping portion 300 configured as described above, the sheet P conveyed by the conveying roller 112 is now conveyed by the oblique-feed rollers 304 and 305, having both edges of the sheet pass within the first and second guide portions 301 and 302.

Here, the grouping portion 300 conveys the sheet P while shifting the sheet P toward the first guide side or the second guide side, thereby correcting skew feed of the sheet P and restricting the position of the sheet P in the width direction.

For example, in order to shift the sheet P toward the first guide side, the first and second rollers 306*a* and 307*a* are brought into contact with the first and second oblique-feed rollers 304*a* and 305*a*, and the third and fourth rollers 306*b* and 307*b* are kept separated from the third and fourth oblique-feed rollers 304*b* and 305*b*.

Accordingly, a conveying force in the direction indicated by the hatched arrow in FIG. 4 is applied to the sheet P by the first and second oblique-feed rollers 304*a* and 305*a*. The guide portion 301A of the first guide 301 restricts the movement of the sheet in upper and lower directions at the edge of the first guide side, and the sheet moves while abutting on the abutting surface 301*a*. As a result, the skew feed of the sheet P is corrected and also the position in the width direction can be set by the abutting surface 301*a*, as shown by the dotted line.

When the sheet P is shifted toward the second guide side, the third and fourth rollers 306*b* and 307*b* are brought into contact with the third and fourth oblique-feed rollers 304*b* and 305*b*, and the first and second rollers 306*a* and 307*a* are kept separated from the first and second oblique-feed rollers 304*a* and 305*a*.

Accordingly, a feeding force is applied to the sheet P by the third and fourth oblique-feed rollers 304*b* and 305*b*. The guide portion 302A of the second guide 302 restricts the movement of the sheet in upper and lower directions at the edge of the second guide side, and the sheet P moves while abutting on the abutting surface 302*a*. As a result, skew feed of the sheet P is corrected and also the position in the width direction can be set by the abutting surface 302*a*.

According to the arrangement described so far, each sheet bundle can be shifted in different direction by controlling the contact and separation of the first to the fourth rollers 306*a*, 307*a*, 306*b* and 307*b*. The maximum shift amount between two sheet bundles is thus 2L.

Next, the configuration of the stacking portion 400 for containing a large volume of sheets will be described referring to FIG. 5, which is a view looking in the direction indicated by the arrow X2 of FIG. 1, FIG. 6, which is a view looking in the direction indicated by the arrow X3 of FIG. 1 and FIG. 7 which is a cross-sectional view taken along the line VII-VII of FIG. 5.

Figure 5:
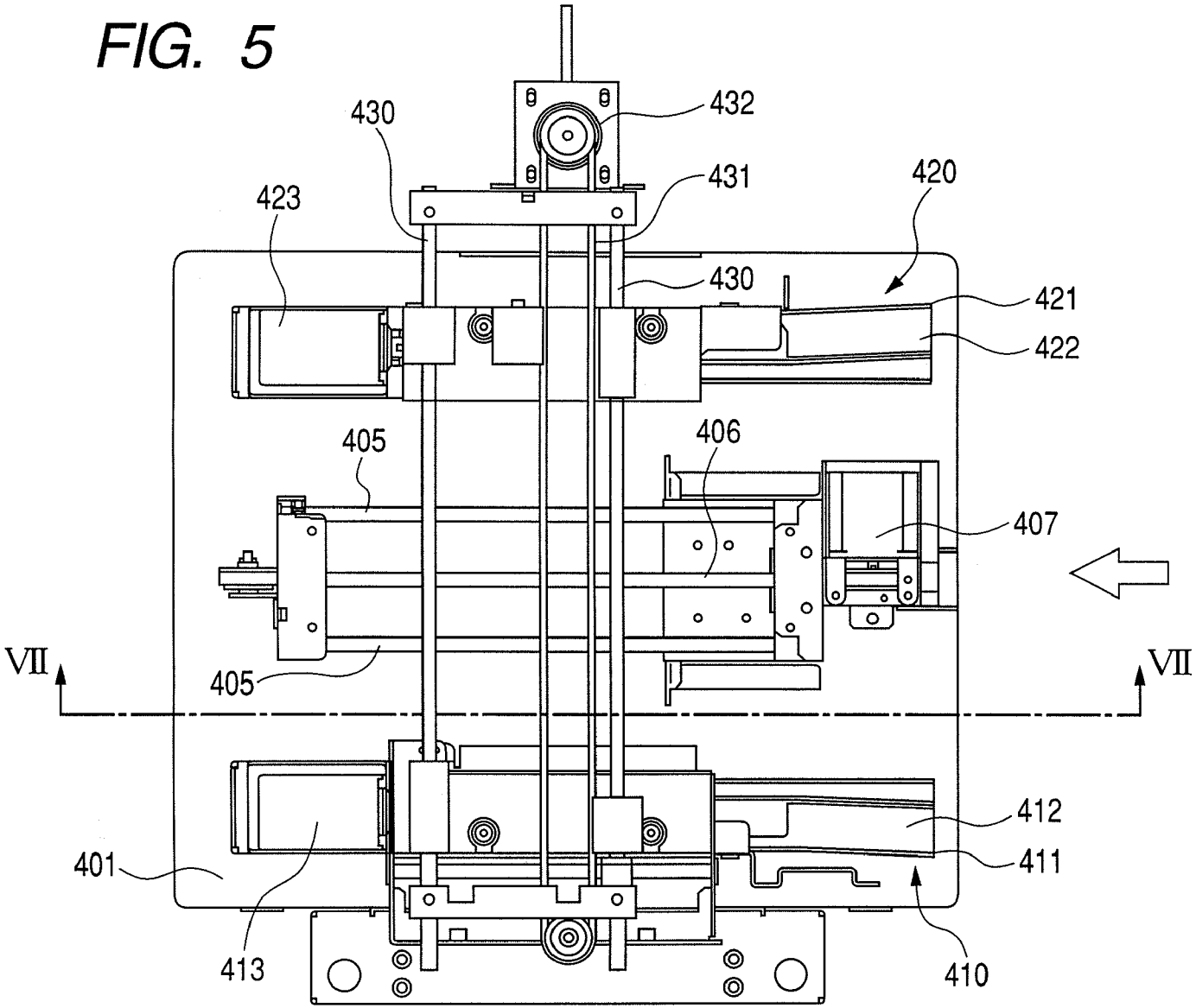
FIG. 5 is a diagram illustrating a configuration of a stacking portion provided in the above stacker.
Figure 6:
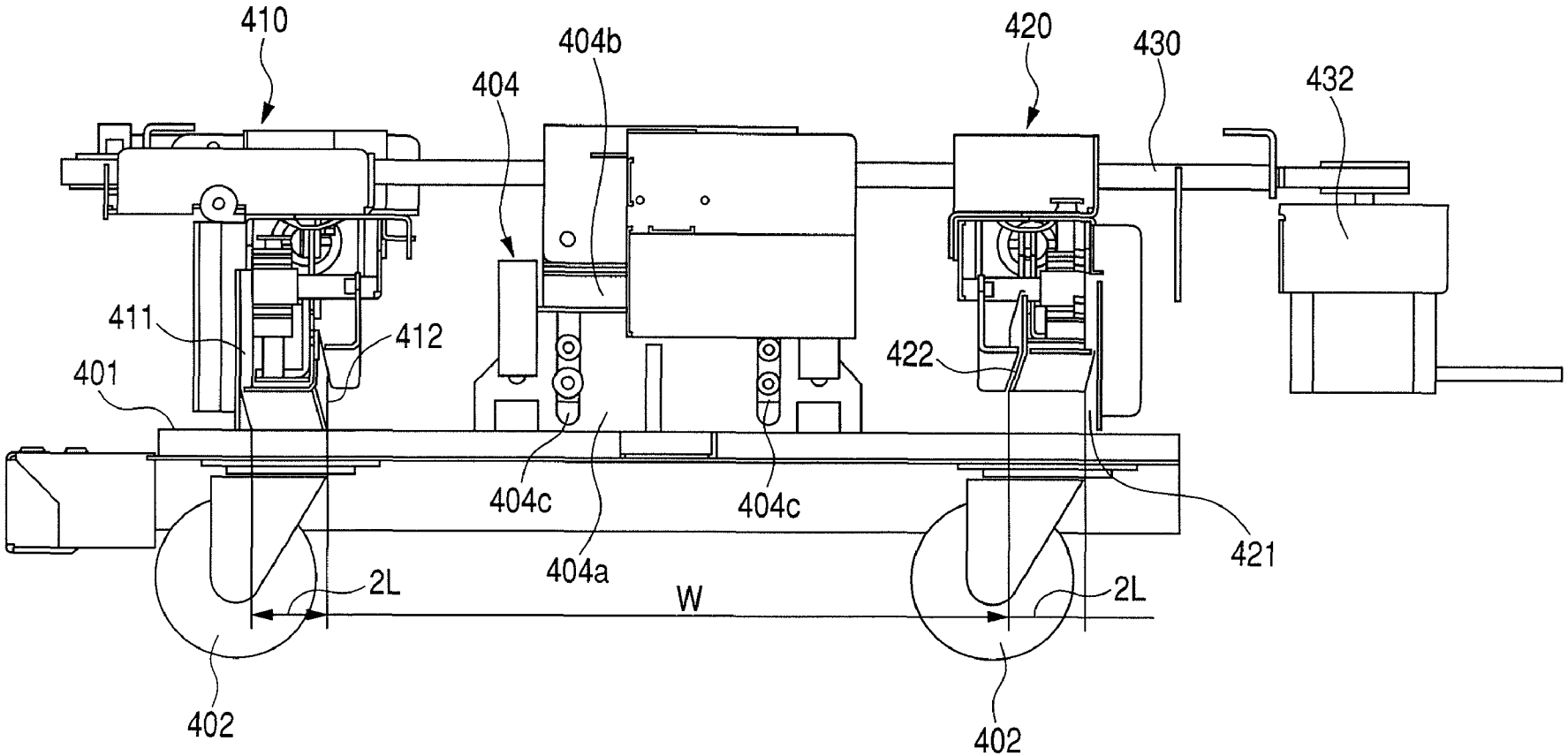
FIG. 6 is a diagram illustrating a configuration of the above stacking portion.
Figure 7:
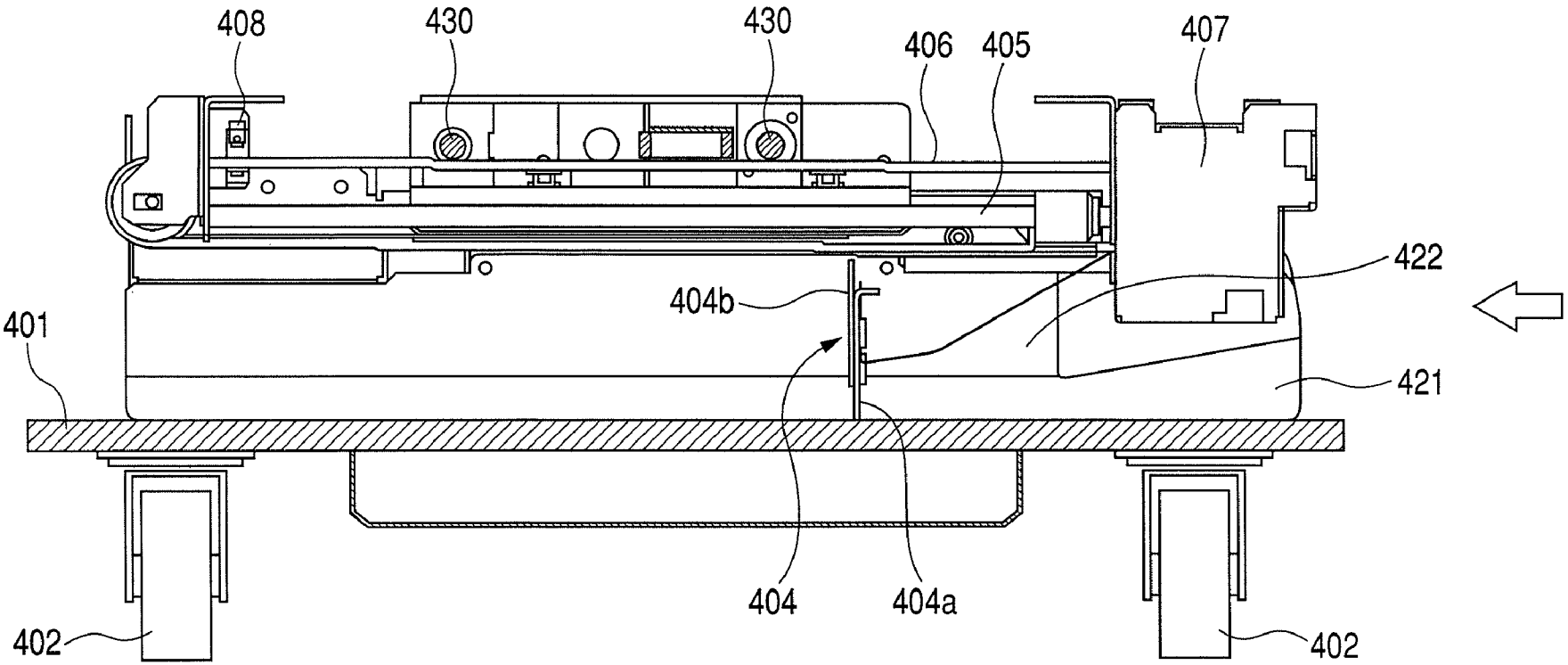
FIG. 7 is a sectional view taken along the line VII-VII of FIG. 5.

The stacking portion 400, as illustrated in FIGS. 5 to 7, includes a stack tray 401, which is a sheet stacking portion for stacking sheets horizontally, a leading edge stopper 404 and first and second side stoppers 410, 420.

The stack tray 401 is arranged to be movable in up and down directions (capable of lifting and lowering) by a lift motor, which is a lifting and lowering unit (not shown). The stack tray 401 is disposed below the discharging roller 114, which discharges the sheet P to the stack tray 401 and the sheet surface detection sensor 403 (shown in FIG. 1) detects the sheet surface position of the stack tray 401. The height position of the stack tray 401 is controlled by the stacker controlling portion 210 so that the top position of the sheet in the stack tray 401 always remains the same based on the output of the sheet surface position detecting sensor 403.

Figure 8:
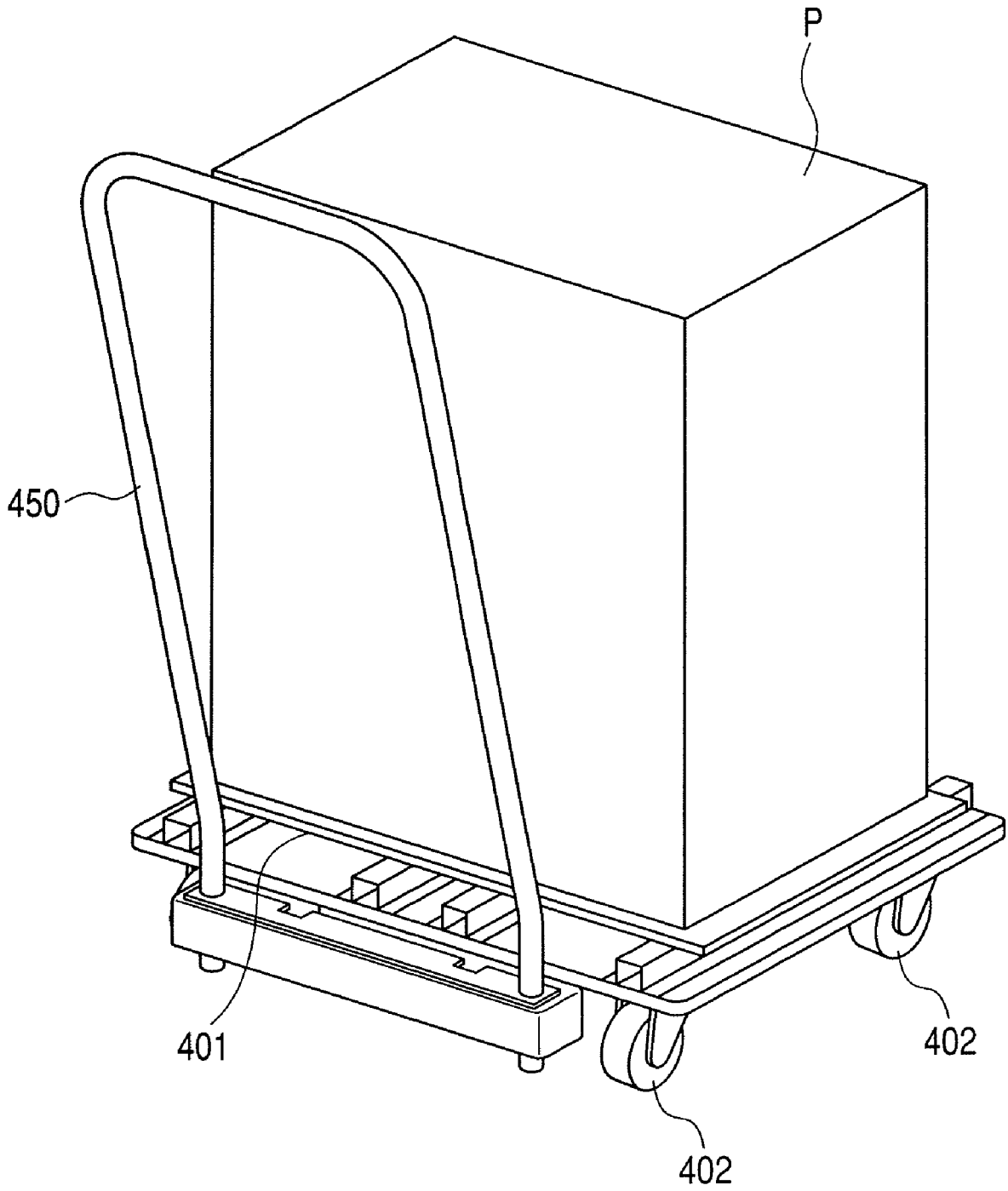
FIG. 8 is a diagram illustrating a configuration of a stack tray provided in the above stacker.

Four casters 402 are mounted on the bottom face of the stack tray 401 so that the whole stack tray 401 can be pulled out from the stacker 100 to be conveyed when a job is completed. FIG. 8 illustrates a state of sheets P of large size stacked in a shiftless manner. A handle 450 is attached to the stack tray 401 to improve conveyance.

The leading edge stopper 404 is to abut on and restrain the leading edge of the sheet discharged to the stack tray 401 in the direction indicated by the arrow in FIGS. 5 and 7. The leading edge stopper 404 is supported by the two slide rails 405 above the stack tray 401 and disposed between the two slide rails 405. Also the leading edge stopper 404 is fixed to a belt 406, which can be moved in the sheet conveyance (discharging) direction by a motor 407. Therefore, if the motor 407 is rotated in forward and reverse directions, the leading edge stopper 404 moves in the sheet conveying direction and the reverse direction.

The leading edge stopper 404 includes an edge plate 404*a* having a perpendicular surface to engage the sheet edge discharged to the stack tray 401 and a fixing member 404*b*, which has an L-like shape connecting the belt 406 and the edge plate 404*a*.

The leading edge plate 404*a*, as illustrated in FIG. 6, is supported by a fixing member 404*b* via four bushes 404*c* so as to be slidable vertically within a predetermined area. Owing to this arrangement, the leading edge plate 404*a* abuts on the stack tray surface by gravity when no sheet is stacked on the stack tray 401. Also the leading edge plate descends as the stack tray 401 descends.

A sensor 408 detects the position of the leading edge stopper 404. The stacker controlling portion 210 drives the motor 407 based on the size information of the sheet to be stacked to move the leading edge stopper 404 appropriately.

Figure 11:
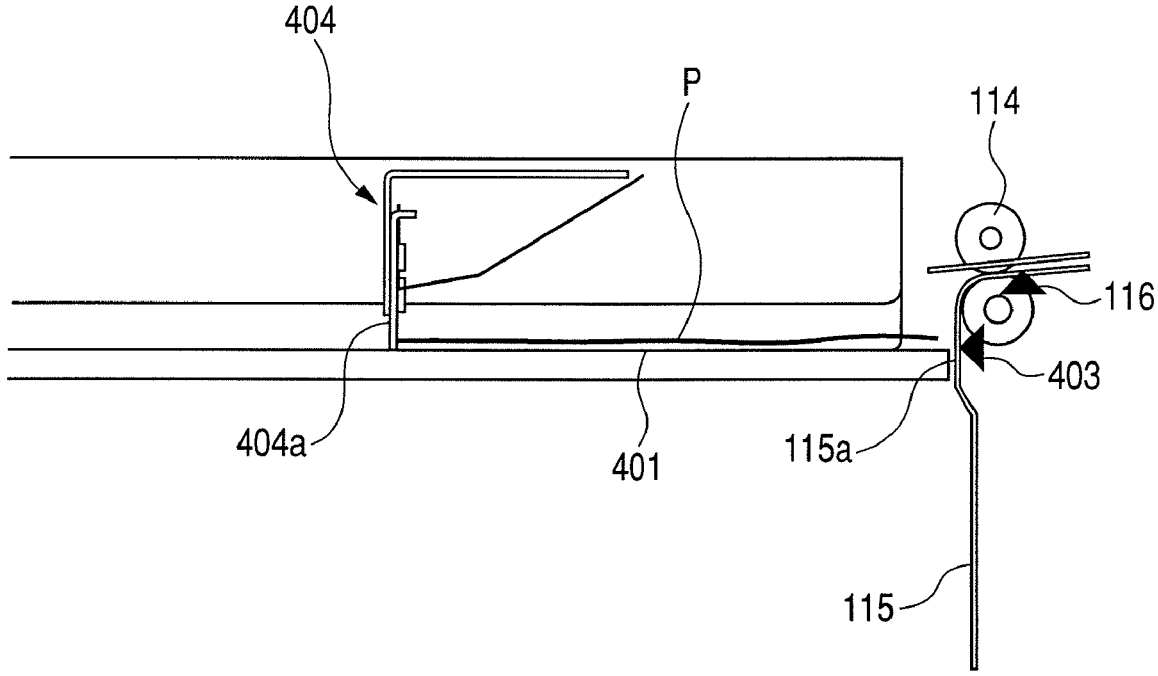
FIG. 11 is a diagram illustrating a state when the shiftless mode of the above stacking portion is selected.

As illustrated in FIG. 1 or FIG. 11, which will be described later, a trailing edge guide 115 is mounted opposite to the leading edge stopper 404 immediately below the discharging roller 114. Consequently, the position of the sheets P contained in the stack tray 401 in the conveying direction is regulated by a span between the leading edge stopper 404 and an abutting face 115*a* of the trailing edge guide 115 illustrated in FIG. 11 to be described later.

The first and second side stoppers 410 and 420 are provided upstream of the leading edge stopper 404 in the sheet discharging direction and make up a pair of side edge regulating members to align the position in the width direction of both edges of the sheet discharged to the stack tray 401.

The first and second side stoppers 410 and 420 are supported by two slide rails 430 above the stack tray 401 and are fitted to a belt 431 driven by the motor 432 so as to be movable in the width direction getting nearer to or further away from each other.

The stacker controlling portion 210 drives the motor 432 based on the sheet size information to move the first and second side stoppers 410 and 420 appropriately corresponding to the signals from the sheet discharging sensor 116.

Here, the first and second side stoppers 410, 420 are provided with the external plates 411, 421, and the internal plates 412, 422 having vertical surfaces to align the sheet side edges. The respective gaps between the external plates 411, 421 and the internal plates 412, 422, illustrated in FIG. 6, are equivalent to the shift amount 2L in the grouping portion 300.

The external plates 411, 421 are supported, similarly to the leading edge plate 404*a* of the leading edge stopper 404 as described above, by the first and second side stoppers 410, 420 so as to be slidable vertically within a predetermined area via sliding means (not shown). Owing to this arrangement, the external plates 411, 421 abut on the stack tray surface by gravity when no sheet is stacked on the stack tray 401. Also the external plates 411, 421 descend as the stack tray 401 descends.

The internal plate 412, 422, which are aligning members, are arranged to lift and lower via solenoids 413, 423 and links (not shown). Then, the internal plates 412, 422 are arranged to be supported by a support unit including the solenoids 413, 423 and the links so as to be capable of descending by a certain distance accompanied by descending of the stack tray 401 in a state that the internal plates 412, 422 are laid on the sheet bundles stacked in the sheet tray 401. Note that in the exemplary embodiment the descending distance of the internal plates 412, 422 are shorter than that of the other aligning members of external plates 411, 421 and the leading edge plate 404*a*, which is an abutting member of the leading edge stopper 404.

Due to this arrangement, as described later, when the number of the stacked sheets becomes 40, for example, and then the stack tray 401 descends corresponding to the number of sheets stacked, the internal plates 412, 422 become released from the sheets in the stack tray.

It should be noted that in FIG. 6 the internal plate (hereinafter referred to as the first internal plate) 412 in the side of the first side stopper is positioned lower due to a switched-OFF state of the solenoid 413, in which state the internal plate 412 abuts on the stack tray surface if there is no sheet on the stack tray 401, and abuts on the sheet if there are sheets. On the contrary, the internal plate (hereinafter referred to as the second internal plate) 422 in the side of the second side stopper is positioned higher due to a switched-ON state of the solenoid 423.

Here, when the sheet P is to be shifted with respect to the first guide 301 in the aforementioned grouping portion 300, the first internal plate 412 is placed at the lower position, which is an aligning position abutting on the side edge of the sheet P to align the width direction position. Meanwhile the second internal plate 422 is in a higher position, which is an upper retreat position. Thereby, the sheet that is shifted with respect to the first guide 301 in the grouping portion 300 is stored between the first internal plate 412 and the external plate 421 (hereinafter referred to as the second external plate) of the second side stopper 420.

On the contrary, when the sheet P is stored, which was shifted with respect to the second guide 302 in the grouping portion 300, the first internal plate 412 is placed at the higher position and the second internal plate 422 is placed at the lower position. Thereby the sheets are stored between the external plate 411 (hereinafter referred to as the first external plate) of the first side stopper 410 and the second internal plate 422.

Next, the sheet stacking operation to the stacking portion 400 in the stacker 100 will be described. Note that the stacker 100 includes two modes in the present embodiment, which are a shiftless mode where all the sheets in the stack tray are stacked at the same position and a shift mode where the sheets discharged to the stack tray are stacked while being shifted (displaced) in the width direction for every bundle of sheets.

Firstly, the sheets stacking operation in the shiftless mode will be described.

When the shiftless mode is selected, the shift direction at the grouping portion 300 remains the same and an operator can select between a shift to the first guide side and to the second guide side. Here the shift to the first guide side will be described.

When the shift to the first guide side is selected by the operating portion 209 illustrated in FIG. 2, the stacker controlling portion 210 outputs a control signal to the grouping portion 300 and the stacking portion 400 via the CPU circuit portion 206 before the sheet is conveyed to the stacker 100.

Based on this control signal, the grouping portion 300 makes the first and second guides 301, 302 stand by at a wider position by a dimension L with respect to the sheet size (width) respectively. In addition, the first and second rollers 306*a*, 307*a*, which are illustrated in FIG. 4, are made to be in contact with the first and second oblique-feed rollers 304*a*, 305*a* and the third and fourth rollers 306*b*, 307*b* are kept to stand by away from the third and fourth oblique-feed rollers 304*b*, 305*b*.

In the stacking portion 400, the first and second side stoppers 410, 420 are kept to stand by, as illustrated in FIG. 6, such that the first and second external plates 411, 421 are positioned at a standby position expanded slightly (by 2 mm) wider than 2L with respect to the sheet size (a length in sheet width direction) W, respectively. Further, the first internal plate 412 is placed to stand by at the lower position and the second internal plate 422 is placed to stand by at the higher position.

The leading edge stopper 404 is kept to stand by at a standby position in which the distance between the leading edge plate 404*a* and the abutting surface 115*a* of the trailing edge guide 115 is expanded slightly (by 2 mm) wider than the sheet size (a sheet length in sheet conveying direction). At that time, the stack tray 401 stands still in a state that the sheet face or the stack tray face if there is no sheet stacked is detected by the sheet surface detecting sensor 403 shown in FIG. 1.

Next, after the first and second guides 301, 302 and the first and second side stoppers 410, 420 are moved to the standby position (initial position), the sheets are conveyed to the stacker 100. The sheets conveyed to the stacker 100 like this are conveyed to the grouping portion 300 by the conveying roller 112 after passing through the pairs of conveying rollers 108, 109, 110 by switching of the top tray switching flapper 103.

Figure 9:
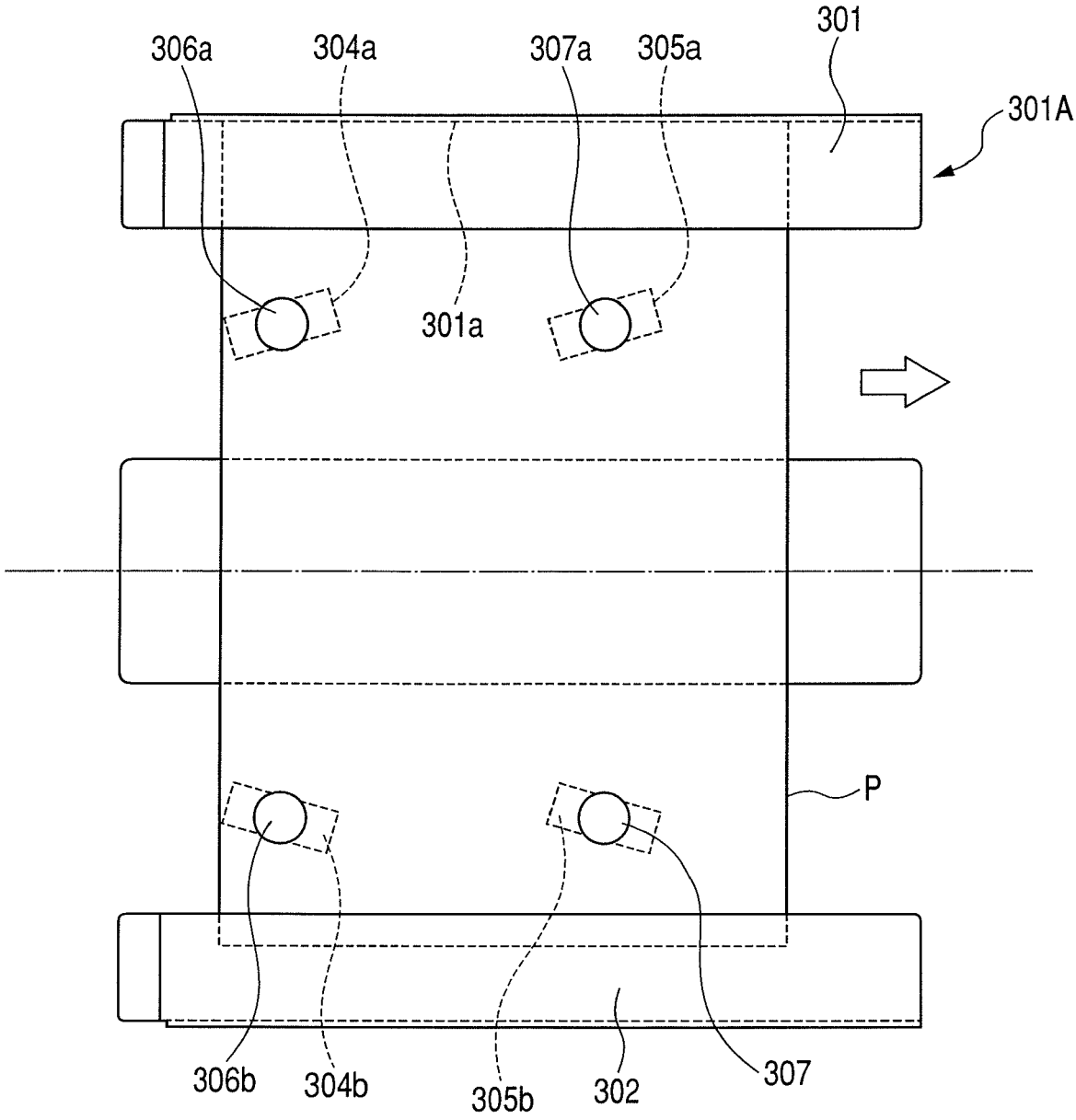
FIG. 9 is a diagram illustrating a state when a shiftless mode of the above grouping portion is selected.

Then, in the grouping portion 300, as illustrated in FIG. 9, the sheet P is nipped between the first and second oblique-feed rollers 304*a*, 305*a* and the first and second rollers 306*a*, 307*a*, and conveyed in a skew feed manner to abut on the abutting surface 301*a* of the guide portion 301A on the first guide side. Thereby the sheet P is conveyed with respect to the abutting surface 301*a*, being corrected in the skew feed and the position of the width direction.

Figure 10A:
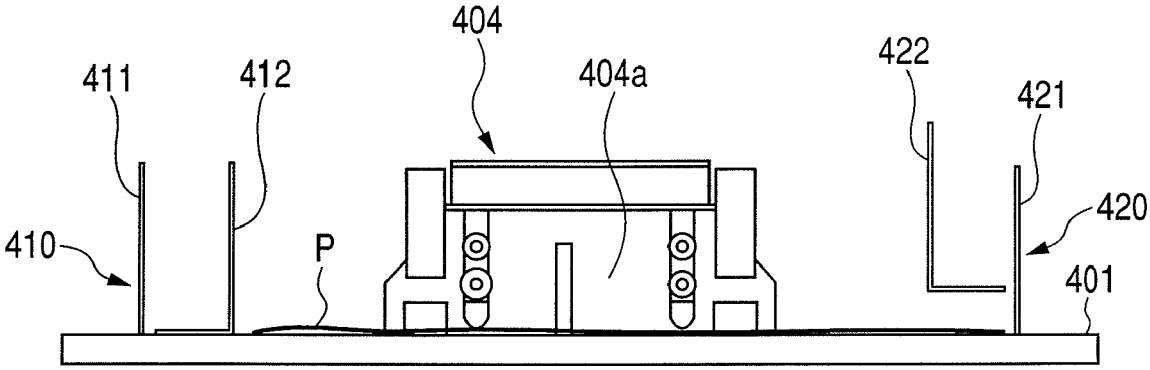
FIGS. 10A and 10B are diagrams illustrating a state when a shiftless mode of the above stacking portion is selected.

Thereafter, as illustrated in FIG. 10A, the sheet P is discharged to the stack tray 401 by the discharging roller 114, entering between the second external plate 421 and the first internal plate 412. On this occasion, as described already, the leading edge plate 404*a* of the leading edge stopper 404, the second external plate 421 and the first internal plate 412 are abutted against the stack tray surface.

Therefore, the leading edge of the discharged sheet P is stopped by the leading edge plate 404*a* of the leading edge stopper 404 as illustrated in FIG. 11. Also, the both side edges of the sheet P are confined by the second external plate 421 and the first internal plate 412, and the leading edge and trailing edge of the sheet P in the sheet discharging direction are confined by the leading edge plate 404*a* of the leading edge stopper 404 and the abutting surface 115*a* of the trailing edge guide 115.

Thereafter, the stacker controlling portion 210 drives the motor 432 to move the first and second side stoppers 410, 420 based on a detection signal of the sheet discharging sensor 116, which is disposed in a vicinity of the discharging roller 114 as illustrated in FIG. 11, for detection of the sheet P.

Figure 10B:
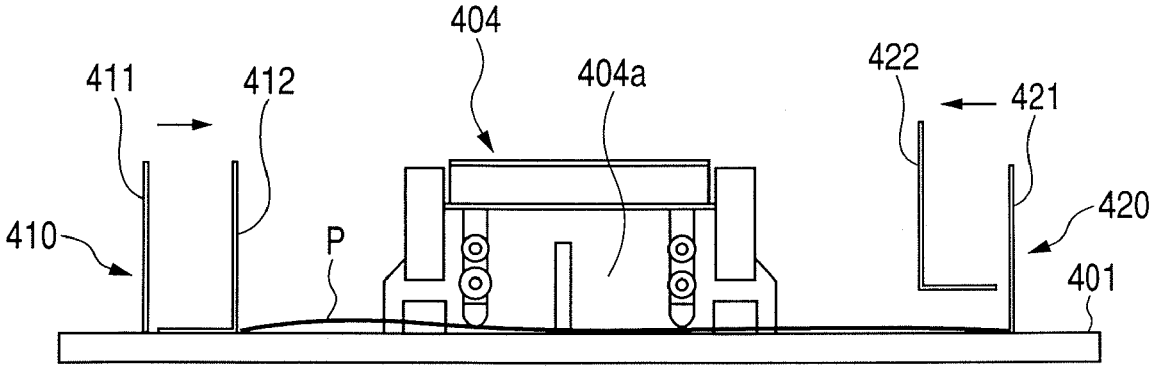

Owing to this, the first and second side stoppers 410, 420, which are disposed upstream of the leading edge stopper 404 in the sheet conveying direction, moves toward one another (in the direction getting closer to the sheet P) by 2 mm respectively from the standby position, as illustrated by the arrows in FIG. 10B. As a result, the distance between the second external plate 421 and the first internal plate 412 becomes equal to the sheet size (width) and the side edges of the sheet P are brought into contact with the plates, and thereby an aligning operation of the discharged sheet P in the width direction can be performed.

After the width direction aligning operation of the sheet described above has been performed, the first and second side stoppers 410, 420 move to the standby position, which is a position expanded wider by 2 mm again to be ready for the next discharged sheet.

Figure 12:
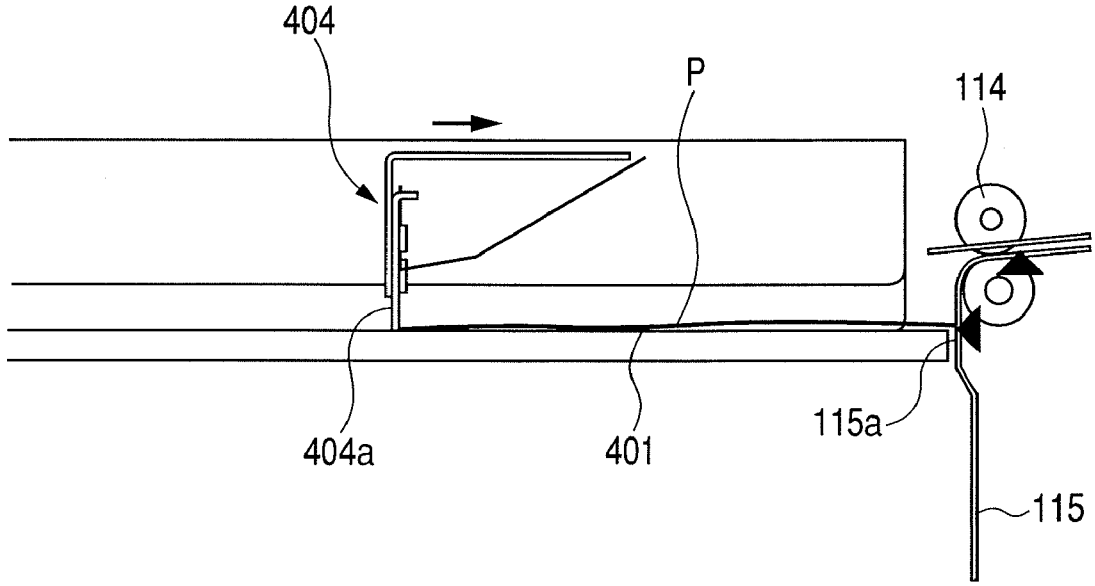
FIG. 12 is a diagram illustrating an aligning operation of a sheet in a sheet conveying direction by a leading edge stopper of the above stacking portion.

Subsequently, as illustrated by an arrow in FIG. 12, the leading edge stopper 404 disposed downstream in the sheet conveying (discharging) direction moves upstream (direction getting closer to the sheet P) by 2 mm actuated by the motor 407. Due to this, the distance between the leading edge plate 404*a* of the leading edge stopper 404 and the abutting surface 115*a* of the trailing edge guide 115 becomes equal to the length of the sheet P in the conveying direction, and thus an aligning operation of discharged sheets P in the sheet conveying direction can be performed.

After the sheet aligning operation in the sheet conveying direction is performed in this way, the leading edge stopper 404 moves again to the standby position, which is a position expanded wider by 2 mm, to be ready for subsequently discharged sheets.

Thus, the above-mentioned operation is repeated every time a sheet is discharged until the last sheet is discharged, and thereby a required number of sheets P are stacked on the stack tray 401. Until the required number of sheets P are stacked, the stacker controlling portion 210 controls the height position of the top sheet surface in the stack tray 401 so as to be a detecting position of the sheet surface detection sensor 403.

Figure 13:
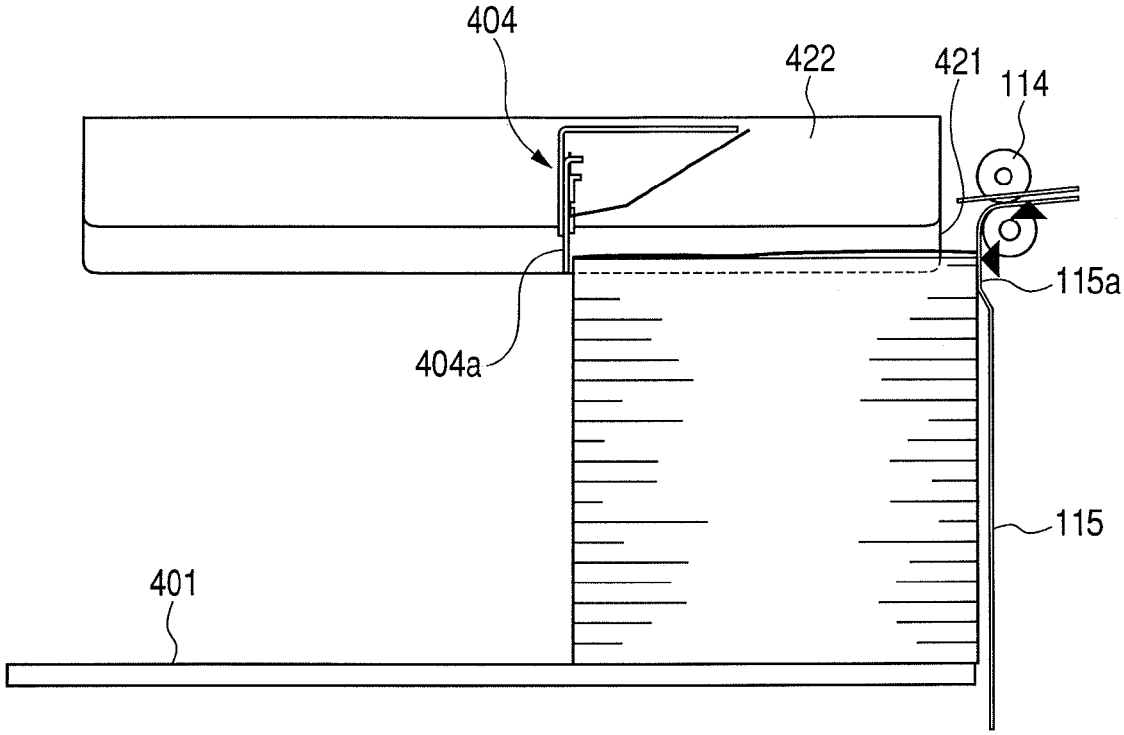
FIG. 13 is a diagram illustrating a state of the stacking portion when the above stacking tray descends.

As stacking progresses, as illustrated in FIG. 13, the leading edge plate 404*a* of the leading edge stopper 404, the second external plate 421 and the first internal plate 412 are getting away from the face of the stack tray 401. However, the leading edge plate 404*a* and the second external plate 421 can move downward by gravity within the sliding area as described above.

Therefore even if there is a small variation in the height position of the stacked sheet surface in the stack tray 401, it is possible to move securely the aligned sheets P downward together with the stack tray 401, keeping the alignment of the sheets.

When the shift toward the second guide side is selected, the first and second rollers 306*a*, 307*a* illustrated in FIG. 4 are separated from the first and second oblique-feed rollers 304*a*, 305*a*. The third and fourth rollers 306*b*, 307*b* are brought into contact with the third and fourth oblique-feed rollers 304*b*, 305*b*. Further in the stacking portion 400, the internal plate (hereinafter referred to as the first internal plate) 412 of the first side stopper side of the first and second side stoppers 410, 420 is located in higher position for standby, and the second internal plate 422 is in lower position for standby.

Incidentally, in the present embodiment, the aligning operation of the sheets P is not to be done in both directions simultaneously for the sheet conveying direction and the width direction, but one direction at a time, which enables the sheet to follow the aligning surface with ease and to correct skew of the sheets securely.

Furthermore, in the present embodiment as described above, the aligning operation by the first and second side stoppers 410, 420, which are disposed upstream of the leading edge stopper 404 in the sheet conveying direction, is arranged to be performed first, and the aligning operation by the leading edge stopper 404 is performed next.

The aligning operation by the first and second side stoppers 410, 420 is performed first as described above, so that the first and second side stoppers 410, 420 can be moved to the standby position before a subsequent sheet is discharged to the stack tray 401.

In addition, in the present embodiment, the first and second side stoppers 410, 420 are arranged to move away from the sheet before the aligning operation by the leading edge stopper 404 is completed.

By such an arrangement the subsequent sheet can be discharged to the stack tray 401 with a timing not to collide against the leading edge stopper 404 after moving to the aligning position. Accordingly the discharge interval of the sheets P to the stack tray 401 can be shortened and the sheets P can be stacked steadily with high speed and high precision.

As described so far, the first and second side stoppers 410, 420 are arranged to move away from the sheet after the first sheet alignment but before the aligning operation by the leading edge stopper 404 is completed. Due to this arrangement, the sheets can be stacked steadily with high speed and high precision. Owing to this, it is possible to cope with an image forming apparatus 900, which has shorter time intervals between discharging of sequential sheets, thereby providing higher productivity.

Next, the sheet stacking operation in the shift mode will be described.

When the shift mode is selected, for example, in order to shift the initial sheet bundle to be stacked in the stack tray 401 to the first guide side, the sheets are stacked on the sheet tray 401 in the same way as the stacking operation for the shiftless mode as described above.

Next, when a subsequent sheet bundle is shifted to the second guide side and stacked on that side, immediately after the last sheet of the previous sheet bundle passes, the first and second rollers 306*a*, 307*a*, illustrated in FIG. 4 are separated from the first and second oblique-feed rollers 304*a*, 305*a*. At the same time the third and fourth rollers 306*b*, 307*b* are brought into contact with the third and fourth oblique-feed rollers 304*b*, 305*b*.

Figure 14:
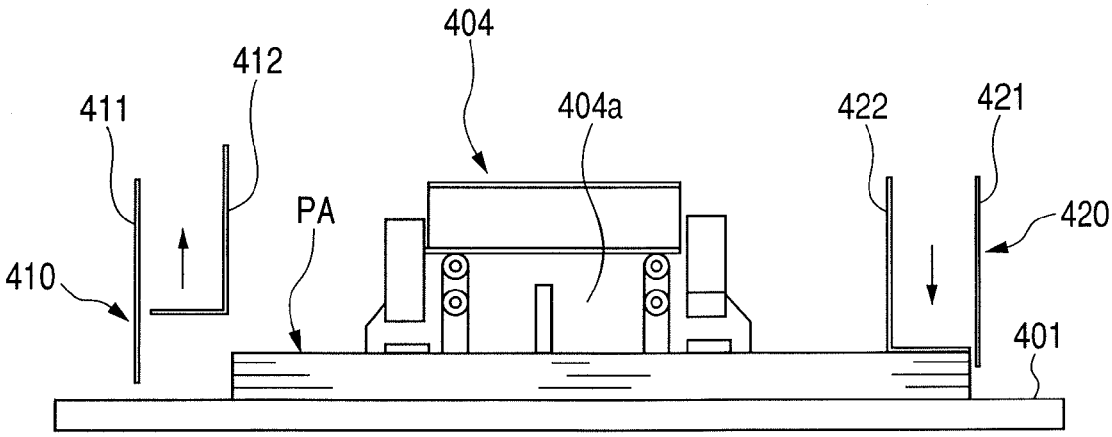
FIG. 14 is a first diagram illustrating a sheet stacking operation when a shift mode of the above stacking portion is selected.

In the stacking portion 400, as illustrated in FIG. 14, the first and second internal plates 412, 422 of the first and second side stoppers 410, 420 are arranged to be in a higher position and a lower position respectively for standby by changing over. On this occasion, the second internal plate 422, which has moved to the lower position, is laid on the sheet bundle PA shifted to and stacked on the first guide side.

Next, after the first and second guides 301, 302, and the first and second side stoppers 410, 420 move to the standby position (initial position), the sheets are conveyed to the grouping portion 300 by the conveying roller 112.

Figure 15:
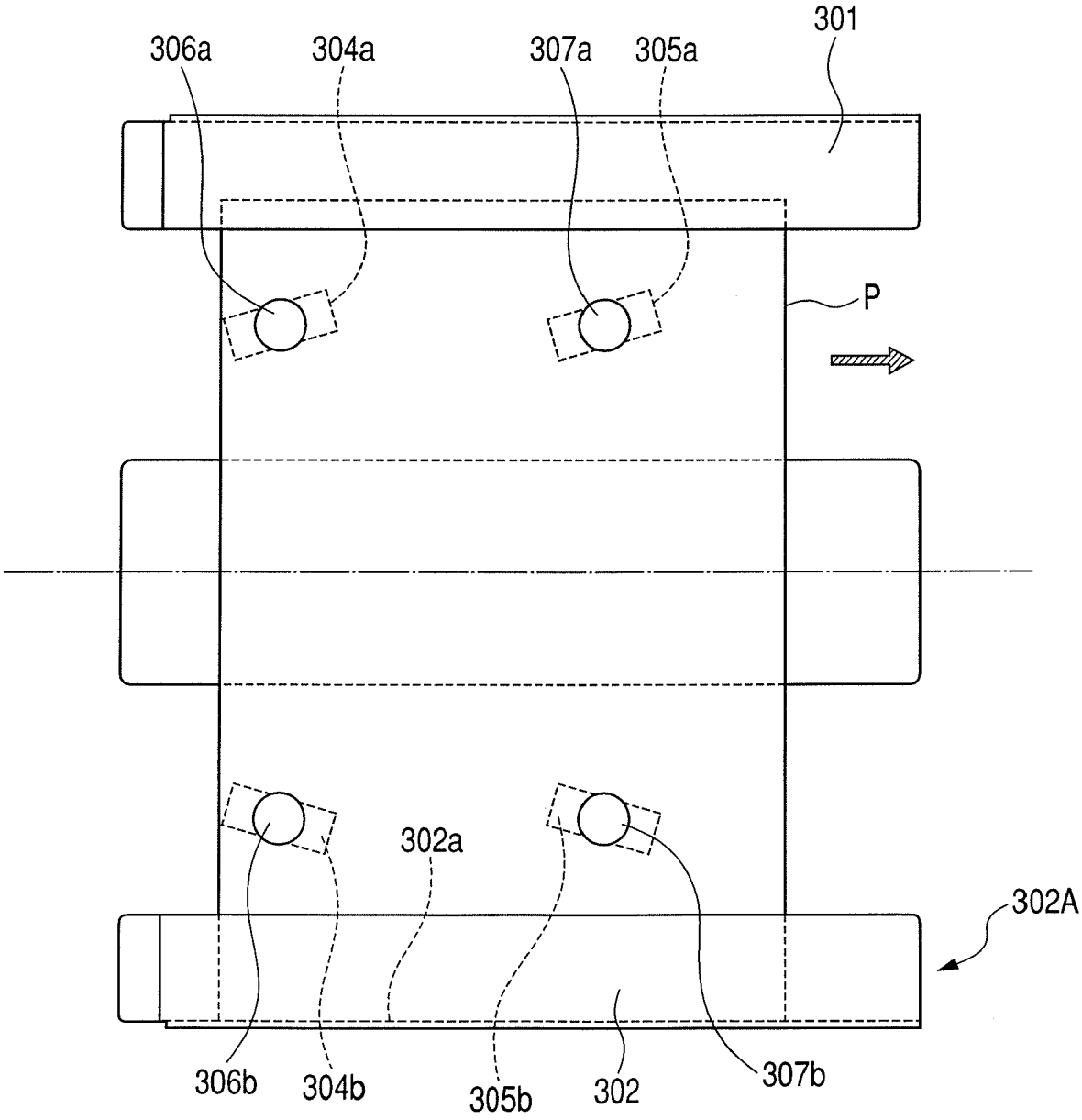
FIG. 15 is a diagram illustrating a state when the shift mode of the above grouping portion is selected.

In the grouping portion 300, as illustrated in FIG. 15, the sheet P is nipped for the oblique-feed by the third and fourth oblique-feed rollers 304*b*, 305*b* and the third and fourth rollers 306*b*, 307*b*, thereafter the sheet abuts on the abutting surface 302*a* of the guide portion 302A of the second guide side. Thereby, the skew feed and the width direction position are corrected and the sheet P is conveyed with reference to the abutting surface 302*a*.

Figure 16:
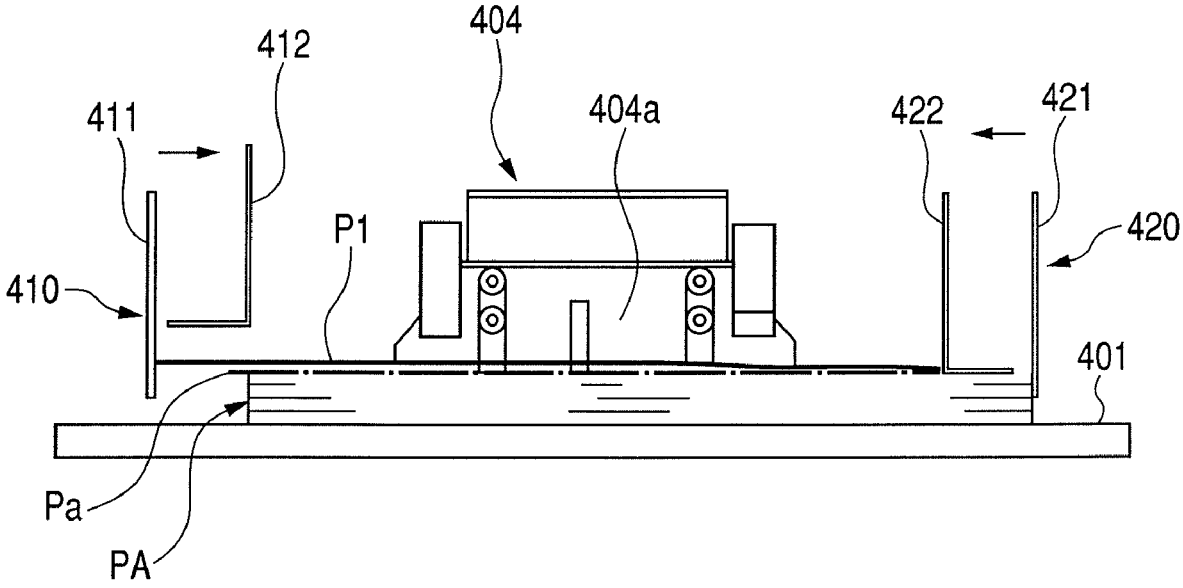
FIG. 16 is a diagram illustrating a malfunction when a shift mode of the above stacking portion is selected.

Thereafter, the sheet P1 discharged by the discharging roller 114, as illustrated in FIG. 16, enters between the first external plate 411 and the second internal plate 422 to be stacked on the top surface of the sheet bundle PA shifted to and stacked on the first guide side.

At that time, the leading edge plate 404*a* of the leading edge stopper 404 and the second external plate 421 abut on the side surfaces of the sheet bundle PA, and the second internal plate 422 abuts on the top surface of the sheet bundle PA. Therefore the leading edge of the discharged sheet P1 is stopped by the leading edge plate 404*a* of the leading edge stopper 404.

Thereby, when the sheets are discharged to the stack tray 401, the sheets are surrounded by the first external plate 411 and the second internal plate 422 for the side edges of the sheets P1, and by the leading edge plate 404*a* of the leading edge stopper 404 and the abutting surface 115*a* of the trailing edge guide 115 for the leading and trailing edges of the sheets P1 in the sheet discharging direction.

On this occasion the second internal plate 422 is laid on the already-stacked sheet bundle. Therefore, when the aligning operation is performed, thereafter, by the first and second side stoppers 410, 420 as described above, the second internal plate 422 slides on the already-stacked sheet bundle and the uppermost sheet Pa of the already-stacked sheet bundle PA is fed together with the second internal plate 422 in association with the slide of the second internal plate 422 as illustrated in FIG. 16, resulting in disordering the alignment of the sheet P.

Since the moving distance of the first and second side stoppers 410, 420 is 2 mm, one aligning operation may deviate the uppermost sheet (hereinafter referred to as the already-stacked uppermost sheet) Pa in the already-stacked sheet bundle PA by 2 mm in the worst case. Then, repeated aligning operations increase the deviation amount.

In order to avoid such deviation, the aligning operation in the width direction is performed collectively only once for each first predetermined number of stacked sheets, before the second internal plate 422 is separated from the uppermost sheet Pa of the already-stacked sheets due to descent of the stack tray 401 accompanied with stacking of the sheet P1. Note that, in the present embodiment, the first predetermined number of the stacked sheets is 20, and as the number of the stacked sheets increases, the stack tray 401 descends accordingly. Accompanying with this, the number of sheets at which the second internal plate 422 is separated from the already-stacked uppermost sheet Pa is to be a number of sheets exceeding 40 sheets as described above.

In other words, in the present embodiment, the aligning operation by the first and second side stoppers 410, 420 is performed collectively every time each 20 sheets are stacked on the stack tray 401. In addition, after the second internal plate 422 is separated from the already-stacked uppermost sheet Pa by the stack tray 401, on which 40 sheets have been stacked, descending, the aligning operation is performed every time the second predetermined number of sheets is discharged. In the present embodiment, after the second internal plate 422 is separated from the already-stacked uppermost sheet Pa, the aligning operation is performed every time a sheet is discharged.

According to such arrangement, sheets to be shifted to the second guide side and discharged to the stack tray 401 are aligned only by the aligning operation of the leading edge stopper 404 in the sheet conveying direction every time one sheet is stacked, up to 19 sheets. At this time, the first and second side stoppers 410, 420 stand still at the standby position.

Figure 17A:
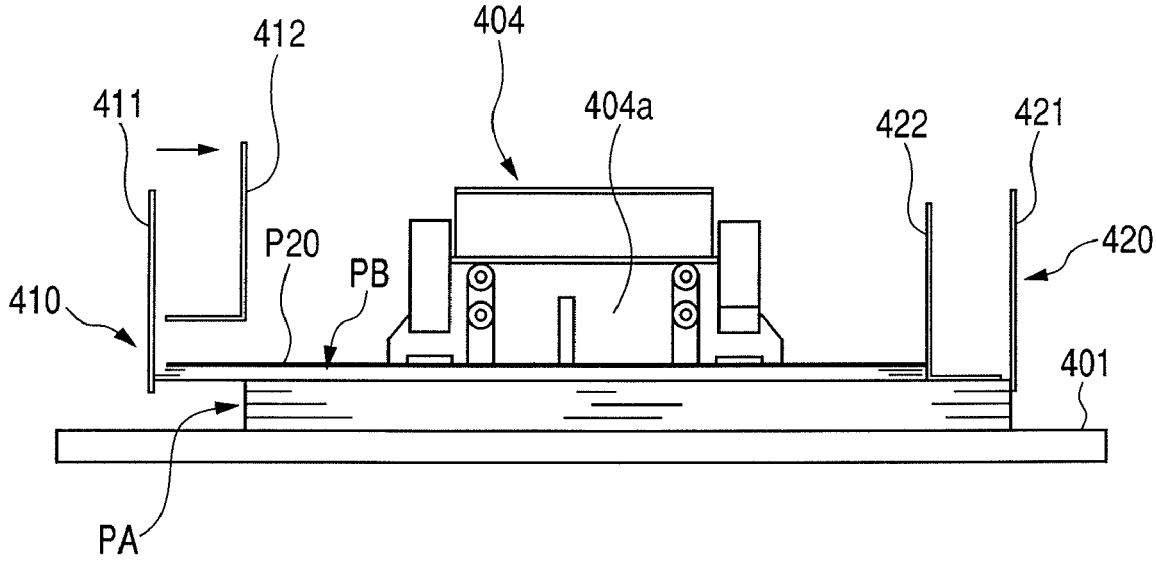
FIGS. 17A and 17B are second diagrams illustrating a sheet stacking operation when a shift mode of the above stacking portion is selected.

As illustrated in FIG. 17A, when the 20th sheet is discharged, the first and second side stoppers 410, 420 move toward one another (getting closer to the sheet) by 2 mm respectively actuated by the motor 432. Thereby, the distance between the first external plate 411 and the second internal plate 422 becomes equal to the width of the sheet P, hence the aligning operation in the width direction can be performed collectively for the sheet bundle PB of the discharged 20 sheets.

After the aligning operation of the sheet bundle PB in the width direction, the first and second side stoppers 410, 420 move to the standby position, which is a position expanded by 2 mm, again to be ready for the subsequent discharged sheet. Thereafter, the aligning operation for the sheet conveying direction of the sheet bundle PB by the leading edge stopper 404 as described above is performed.

Figure 17B:
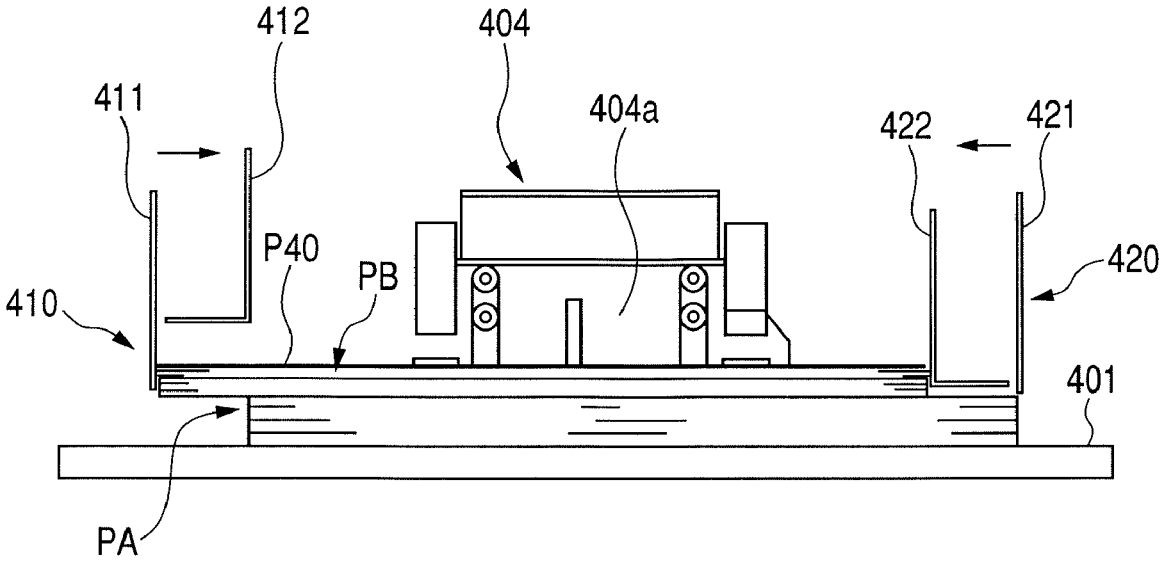
Figure 18A:
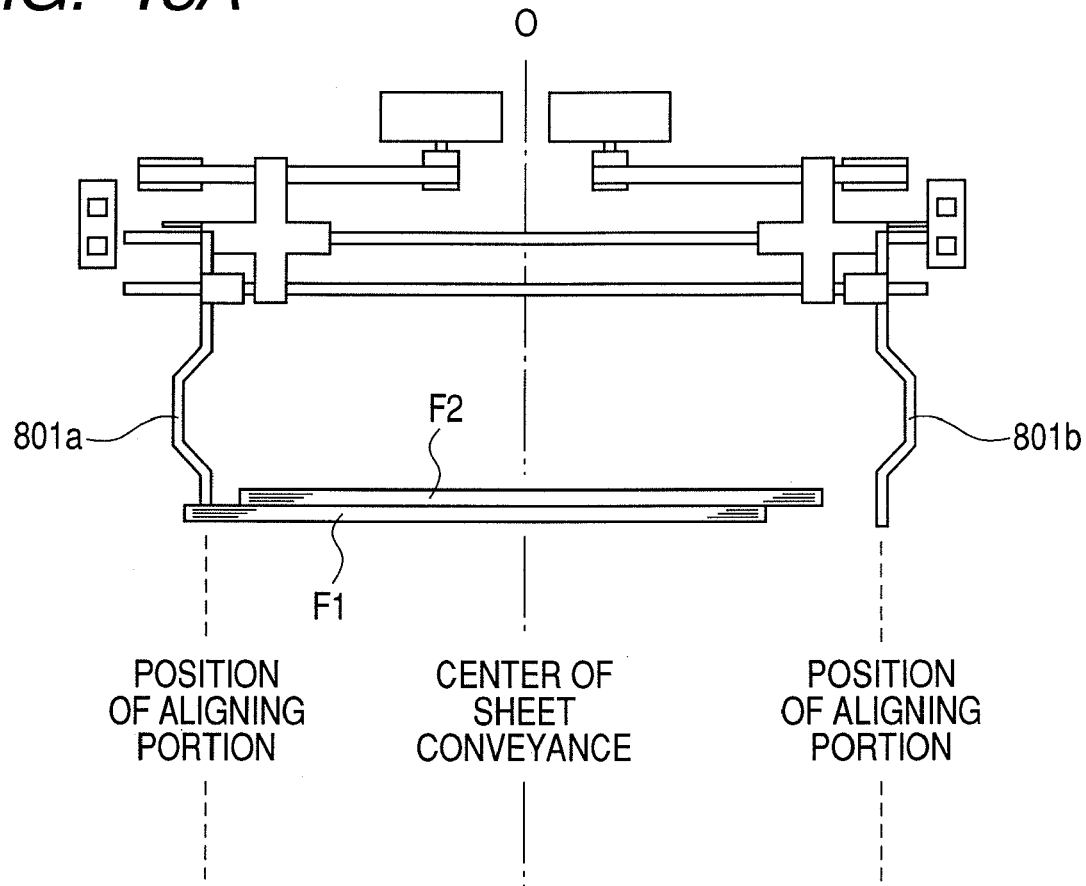
FIGS. 18A and 18B are diagrams illustrating a configuration of a conventional sheet stacking apparatus.
Figure 18B:
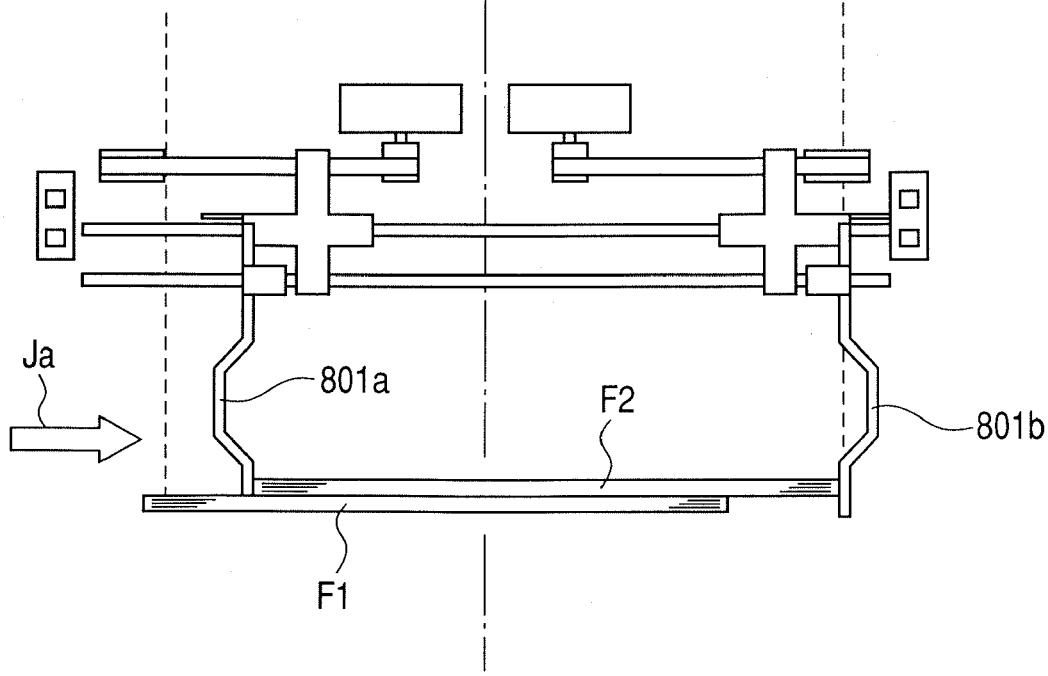

Such collective aligning operation is also applied for the subsequent 20 sheets to be discharged, and a sheet P40 exceeding 40 sheets is stacked in due course as illustrated in FIG. 17B. Since the number of stacked sheets at which the second internal plate 422 is separated from the already-stacked uppermost sheet Pa exceeds 40, and thus when the sheet P40 exceeding 40 sheets is stacked and the stack tray 401 descends, the second internal plate 422 is separated from the already-stacked uppermost sheet Pa.

After the second internal plate 422 is separated from the already-stacked uppermost sheet Pa, even when the aligning operation by the first and second side stoppers 410, 420 is performed, the internal plate 422 never slides on the already-stacked uppermost sheet Pa to feed the already-stacked uppermost sheet Pa in association with the sliding of the internal plate 422.

When the sheet P after the 41st onwards is discharged, the aligning operation by the first and second side stoppers 410, 420 and the aligning operation by the leading edge stopper 404 are performed every time a sheet is discharged just like the case of the 20th sheet and the 40th sheet, since the second internal plate 422 has been separated from the already-stacked uppermost sheet Pa.

Also the last sheet in a case where the number of sheets in the sheet bundle PB is not more than 40, the sheet is stacked through the aligning operation by the first and second side stoppers 410, 420 and the aligning operation by the leading edge stopper 404 just like the case of 20th sheet and from the 40th sheet onward.

When stacking with a shift to the second guide side is completed, and there are still sheet bundles to be stacked, stacking is continued through changing to the stacking with a shift to the first guide side again. In this case again, the first and second side stoppers 410, 420 perform the aligning operation every 20 sheets up to the first 40 sheets. Such operations as described above are repeated up to the final bundle to stack the required number of sheets on the stack tray 401.

Figure 19:
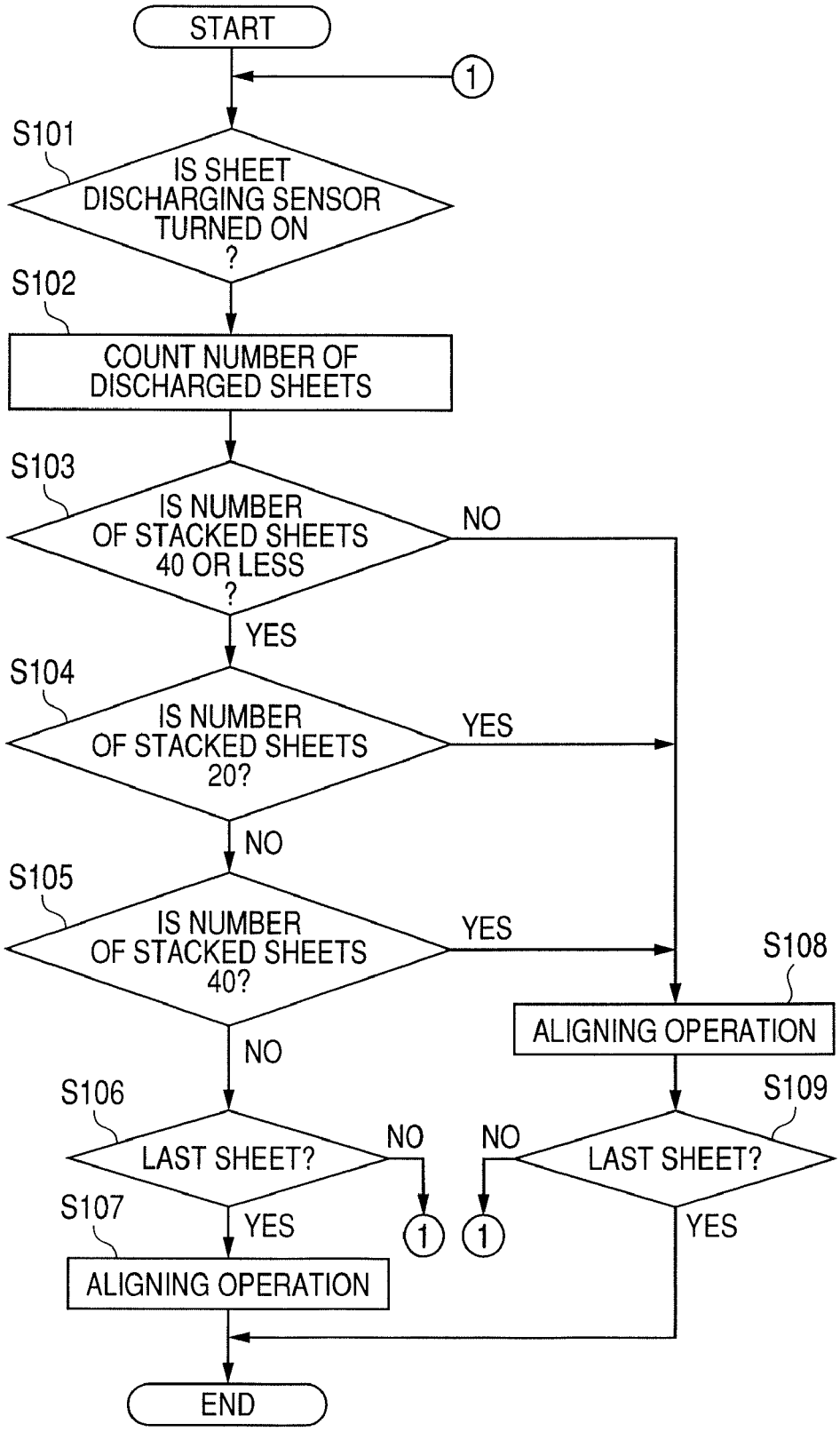
FIG. 19 is a flowchart of an aligning operation of a first and second side stoppers 410, 420 in the shift mode.

FIG. 19 is a flowchart of the aligning operations of the first and second side stoppers 410 and 420. As shown in FIG. 19, when the sheet discharging sensor 116, which detects the coming of a sheet, is turned on (S101), the stacker controlling portion 210 counts a number of discharged sheets (S120). With this, the stacker controlling portion 210 can calculate the number of sheets stacked on a sheet bundle previously stacked and displaced on the stack tray 401.

The stacker controlling portion 210 discriminates whether or not the counted number of stacked sheets is 40 or less (S103). When the counted number of stacked sheets is 40 or less, the stacker controlling portion 210 discriminates whether or not a number of stacked sheets is 20 (S104). When the number of stacked sheets is not 20, the stacker controlling portion 210 discriminates whether or not the number of stacked sheets is 40 (S105). When the number of stacked sheets is not 40, the stacker controlling portion 210 discriminates whether or not it is the last sheet (S106). When it is not the last sheet, the procedure returns to S101. On the other hand, when the stacker controlling portion 210 discriminates that it is the last sheet, the stacker controlling portion 210 controls the first and second side stoppers 410 and 420 to perform the aligning operation (S107). Then, the procedure is ended.

When the number of stacked sheets is not 40 or less, and when the number of stacked sheets is 20 or 40, the stacker controlling portion 210 controls the first and second side stoppers 410 and 420 to perform the aligning operation (S108). Then, after the aligning operation, the stacker controlling portion 210 discriminates whether or not it is the last sheet (S109). When it is not the last sheet, the procedure returns to S101. When it is the last sheet in S109, the procedure is ended.

When such a configuration as described above is adopted, the number of associated feedings of the already-stacked uppermost sheet Pa in association with the aligning operation by the first and second side stoppers 410, 420 is one time only, and the deviation amount thereof is suppressed down to 2 mm or less, which in general gives no practical problems.

As described above, when the internal plates 412, 422 slide on the top surface of the already-stacked sheet bundle, the aligning operation is performed after a plurality of sheets has been stacked. Thereby, even when the sheet bundles are stacked with the sheet bundles being staggered, the sheets can be stacked steadily without disordering the alignment of the already-stacked sheet bundle.

It should be noted that the number of sheets to be aligned collectively within the range of 40 sheets may be altered appropriately depending on aligning performance of a collective aligning and the deviation amount of the associated feeding of the already-stacked uppermost sheet Pa. In general, the larger number of sheets to be collectively aligned, the less deviation amount caused by the associated feedings. On the contrary, the less number of sheets to be collectively aligned, and the better aligning performance of a collective alignment is achieved.

According to the description presented so far, after the second copy (bundle) onwards in the shift mode, the initial sheets up to 40 sheets are divided into groups of 20 sheets, and the 20 sheets are aligned collectively so that the number of associated feedings is reduced so that less amount of deviation is obtained.

However, after the second copy (bundle) onwards in the shift mode, it may be arranged so that no aligning operation is performed up to 40 sheets. In other words, when the number of the subsequent bundle to be stacked is less than or equal to 40, the aligning operation may be performed after all sheets for the subsequent bundle are discharged. In this case, the distance between the external plates 411, 421 of the first and second side stoppers 410, 420 and the opposing internal plates 412, 422 is wider than the sheet size by 2 mm each, which is 4 mm in total.

Therefore, in this case the sheets may have deviation of this amount as maximum (within 4 mm) on the stack tray. But it is better that the first and second side stopper 410, 420 align the sheets after all sheets are discharged on the stack tray than the first and second side stopper 410, 420 aligns sheets every time a sheet is stacked on the stack tray 401. Because the deviation is produced largely beyond 4 mm through moving the first and second side stoppers 410, 420 together every time a sheet is stacked on the stack tray 401.

Also such an arrangement may be adopted that no aligning operation is performed when the internal plates 412, 422 are laid on a sheet bundle previously stacked after the second bundle onwards in the shift mode, and the aligning operation is performed every time the predetermined number of sheets are discharged after the internal plates 412, 422 are separated from the top surface of the sheet bundle previously stacked, accompanying with the stack tray descending.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-297135, filed Oct. 31, 2006, which is hereby incorporated by reference herein in its entirety.

What is claimed is:

1. A sheet stacking apparatus, comprising:

a tray on which sheets are stacked;

an aligning member which aligns sheets, wherein the aligning member aligns the sheets stacked on sheets previously stacked on the tray with a displacement in an aligning direction of the aligning member with respect to the sheets previously stacked;

a moving unit which moves the tray so that the tray is lowered with an increase in the number of the stacked sheets;

a support unit which supports the aligning member so that the aligning member is lowered within a predetermined distance with the aligning member being in contact with a top surface of the sheets previously stacked as the tray is lowered by the moving unit; and a changing unit which changes the aligning operation of the aligning member between a first state in which the aligning member is in contact with the top surface of the sheets previously stacked and a second state in which the number of the sheets stacked on the sheets previously stacked exceeds a predetermined number, the aligning member being spaced away from the top surface of the sheets previously stacked when the number of the sheets stacked on the sheets previously stacked exceeds the predetermined number, wherein the aligning member performs the aligning operation every time a first number of sheets are stacked on the tray in the first state, the aligning member performs the aligning operation every time a second number of sheets are stacked on the tray in the second state, and the first number is larger than the second number.

2. A sheet stacking apparatus according to claim 1, wherein in the second state, the aligning member performs the aligning operation every time a sheet is stacked.

3. A sheet stacking apparatus according to claim 1, wherein in the first state, if the aligning member is not spaced away from the top surface of the sheets previously stacked after all sheets to be stacked on the sheets previously stacked are discharged, the aligning member performs the aligning operation after all sheets are discharged.

4. A sheet stacking apparatus according to claim 1, further comprising:

a conveying unit which conveys sheets to be stacked on the tray, wherein the conveying unit conveys a subsequent sheet to the tray with the position of the subsequent sheet being changed in an aligning direction of the aligning member with respect to a position of a preceding sheet conveyed.

5. An image forming apparatus, comprising:

an image forming unit which forms an image on a sheet;

a tray on which image-formed sheets are stacked;

an aligning member which aligns sheets, wherein the aligning member aligns the sheets stacked on sheets previously stacked on the tray with a displacement in an aligning direction of the aligning member with respect to the sheets previously stacked;

a moving unit which moves the tray so that the tray is lowered with an increase in the number of the stacked sheets;

a support unit which supports the aligning member so that the aligning member is lowered within a predetermined distance with the aligning member being in contact with a top surface of the sheets previously stacked as the tray is lowered by the moving unit; and a changing unit which changes the aligning operation of the aligning member between a first state in which the aligning member is in contact with the top surface of the sheets previously stacked and a second state in which the number of the sheets stacked on the sheets previously stacked exceeds a predetermined number, the aligning member being spaced away from the top surface of the sheets previously stacked when the number of the sheets stacked on the sheets previously stacked exceeds the predetermined number, wherein the aligning member performs the aligning operation every time a first number of sheets are stacked on the tray in the first state, the aligning member performs the aligning operation every time a second number of sheets are stacked on the tray in the second state, and the first number is larger than the second number.

6. An image forming apparatus according to claim 5, wherein in the second state, the aligning member performs the aligning operation every time a sheet is stacked.

7. An image forming apparatus according to claim 5, wherein in the first state, if the aligning member is not spaced away from the top surface of the sheets previously stacked after all sheets to be stacked on the sheets previously stacked are discharged, the aligning member performs the aligning operation after all sheets are discharged.

8. An image forming apparatus according to claim 5, further comprising:

a conveying unit which conveys sheets to be stacked on the tray, wherein the conveying unit conveys a subsequent sheet to the tray with the position of the subsequent sheet being changed in an aligning direction of the aligning member with respect to a position of a preceding sheet conveyed.

9. A sheet stacking apparatus, comprising:

a tray on which sheets are stacked;

an aligning member which aligns sheets, wherein the aligning member aligns the sheets stacked on sheets previously stacked on the tray with a displacement in an aligning direction of the aligning member with respect to the sheets previously stacked;

a moving unit which moves the tray so that the tray is lowered with an increase in the number of the stacked sheets;

a support unit which supports the aligning member so that the aligning member is lowered within a predetermined distance with the aligning member being in contact with a top surface of the sheets previously stacked as the tray is lowered by the moving unit; and a changing unit which changes the aligning operation of the aligning member between a first state in which the aligning member is in contact with the top surface of the sheets previously stacked and a second state in which the number of the sheets stacked on the sheets previously stacked exceeds a predetermined number, the aligning member being spaced away from the top surface of the sheets previously stacked when the number of the sheets stacked on the sheets previously stacked exceeds the predetermined number, wherein the aligning member does not perform the aligning operation in the first state, the aligning member performs the aligning operation in the second state.

10. A sheet stacking apparatus according to claim 9, wherein in the second state, the aligning member performs the aligning operation every time a sheet is stacked.

11. A sheet stacking apparatus according to claim 9, wherein in the first state, if the aligning member is not spaced away from the top surface of the sheets previously stacked after all sheets to be stacked on the sheets previously stacked are discharged, the aligning member performs the aligning operation after all sheets are discharged.

12. A sheet stacking apparatus according to claim 9, further comprising:

a conveying unit which conveys sheets to be stacked on the tray, wherein the conveying unit conveys a subsequent sheet to the tray with the position of the subsequent sheet being changed in an aligning direction of the aligning member with respect to a position of a preceding sheet conveyed.

13. An image forming apparatus, comprising:

an image forming unit which forms an image on a sheet;

a tray on which image-formed sheets are stacked;

an aligning member which aligns sheets, wherein the aligning member aligns the sheets stacked on sheets previously stacked on the tray with a displacement in an aligning direction of the aligning member with respect to the sheets previously stacked;

a moving unit which moves the tray so that the tray is lowered with an increase in the number of the stacked sheets;

a support unit which supports the aligning member so that the aligning member is lowered within a predetermined distance with the aligning member being in contact with a top surface of the sheets previously stacked as the tray is lowered by the moving unit; and a changing unit which changes the aligning operation of the aligning member between a first state in which the aligning member is in contact with the top surface of the sheets previously stacked and a second state in which the number of the sheets stacked on the sheets previously stacked exceeds a predetermined number, the aligning member being spaced away from the top surface of the sheets previously stacked when the number of the sheets stacked on the sheets previously stacked exceeds the predetermined number, wherein, the aligning member does not perform the aligning operation in the first state, and the aligning member performs the aligning operation in the second state.

14. An image forming apparatus according to claim 13, wherein in the second state, the aligning member performs the aligning operation every time a sheet is stacked.

15. An image forming apparatus according to claim 13, wherein in the first state, if the aligning member is not spaced away from the top surface of the sheets previously stacked after all sheets to be stacked on the sheets previously stacked are discharged, the aligning member performs the aligning operation after all sheets are discharged.

16. An image forming apparatus according to claim 13, further comprising:

a conveying unit which conveys sheets to be stacked on the tray, wherein the conveying unit conveys a subsequent sheet to the tray with the position of the subsequent sheet being changed in an aligning direction of the aligning member with respect to a position of a preceding sheet conveyed.

* * * * *